US005659843A

United States Patent [19]

Takano et al.

[11] Patent Number: 5,659,843

[45] Date of Patent: Aug. 19, 1997

[54] IMAGE TRANSFERRING DEVICE FOR IMAGE FORMING EQUIPMENT

[75] Inventors: Satoshi Takano, Tokyo; Itaru Matsuda, Yokohama; Yuko Harasawa, Hayama-machi; Hitoshi Ishibashi, Tokyo; Masumi Sato, Yokohama; Megumi Otoshi, Kawasaki, all of Japan

[73] Assignee: Ricoh Company, Ltd., Tokyo, Japan

[21] Appl. No.: 398,790

[22] Filed: Mar. 6, 1995

Related U.S. Application Data

[63] Continuation-in-part of Ser. No. 6,521, Jan. 21, 1993, abandoned.

[30] Foreign Application Priority Data

| | | | |
|---|---|---|---|
| Jan. 22, 1992 | [JP] | Japan | 4-9125 |
| Mar. 30, 1992 | [JP] | Japan | 4-74366 |
| Nov. 30, 1992 | [JP] | Japan | 4-320937 |
| Mar. 7, 1994 | [JP] | Japan | 6-035960 |
| Jul. 4, 1994 | [JP] | Japan | 6-152061 |

[51] Int. Cl.[6] ..... G03G 15/16; G03G 15/20

[52] U.S. Cl. ..... 399/66; 399/314

[58] Field of Search ..... 355/272, 274, 355/271, 275, 273, 205, 206, 207; 430/126; 399/66, 314

[56] References Cited

U.S. PATENT DOCUMENTS

| | | |
|---|---|---|
| 3,647,292 | 3/1972 | Weikel . |
| 3,830,589 | 8/1974 | Allen . |
| 3,832,053 | 8/1974 | Goel et al. . |
| 4,162,843 | 7/1979 | Inoue et al. . |
| 4,220,699 | 9/1980 | Idshida et al. . |
| 4,268,157 | 5/1981 | Ebi et al. . |
| 4,407,580 | 10/1983 | Hashimoto et al. . |
| 4,411,977 | 10/1983 | Tarumi et al. . |
| 4,931,839 | 6/1990 | Tompkins et al. . |
| 5,040,028 | 8/1991 | Kamimura et al. . |
| 5,053,827 | 10/1991 | Tompkins et al. . |
| 5,138,363 | 8/1992 | Yuge . |
| 5,140,376 | 8/1992 | Gotoda et al. . |
| 5,148,224 | 9/1992 | Yamada et al. . |
| 5,153,653 | 10/1992 | Fuma et al. . |
| 5,172,173 | 12/1992 | Goto et al. . |
| 5,182,598 | 1/1993 | Hara et al. . |
| 5,198,863 | 3/1993 | Goto et al. . |
| 5,268,725 | 12/1993 | Koga et al. . |
| 5,291,253 | 3/1994 | Kumasaka et al. . |
| 5,300,984 | 4/1994 | Fuma et al. . |
| 5,386,274 | 1/1995 | Sanpe et al. . |

FOREIGN PATENT DOCUMENTS

| | | |
|---|---|---|
| 0442527 | 8/1991 | European Pat. Off. . |
| 3908488 | 9/1989 | Germany . |
| 4040962 | 6/1991 | Germany . |
| 56-069653 | 6/1981 | Japan . |
| 59-65866 | 4/1984 | Japan . |
| 1-292378 | 11/1989 | Japan . |
| 2-46477 | 2/1990 | Japan . |

(List continued on next page.)

*Primary Examiner*—Robert Beatty

*Attorney, Agent, or Firm*—Oblon, Spivak, McClelland, Maier & Neustadt, P.C.

[57] ABSTRACT

An image transferring device for image forming equipment and capable of insuring desirable image transfer by obviating premature image transfer, print, and the leak of transfer bias. A belt causes a toner image to be transferred from an image carrier to a transfer medium while conveying it. A bias member applies a charge to the belt. A feedback current from the belt flows through a feedback electrode. A constant current control device executes constant current control such that the difference between a current to flow from the bias member to the belt and the feedback current to flow from the belt to the feedback electrode remains constant. The constant current control is based on PWM having a spatial frequency of either lower than 0.5 cycles/mm or higher than 1.5 cycles/mm. In addition, a current sensing resistor is disposed between a first and second node wherein the first node is connected to a power source for applying current to the bias member and the feedback electrode and the second node is connected to the image carrier.

17 Claims, 17 Drawing Sheets

FOREIGN PATENT DOCUMENTS

| | | |
|---|---|---|
| 2-110586 | 4/1990 | Japan . |
| 3-062077 | 3/1991 | Japan . |
| 3-167579 | 7/1991 | Japan . |
| 3-186876 | 8/1991 | Japan . |
| 3-231273 | 10/1991 | Japan . |
| 3-231274 | 10/1991 | Japan . |
| 3-231783 | 10/1991 | Japan . |
| 4-121767 | 4/1992 | Japan . |

IMAGE TRANSFERRING DEVICE FOR IMAGE FORMING EQUIPMENT

BACKGROUND OF THE INVENTION

The present invention is a continuation-in-part of U.S. application Ser. No. 08/006,521, filed Jan. 21, 1993, abandoned, now U.S. Ser. No. 08/449,778.

The present invention relates to an image transferring device for a copier, printer or similar electrophotographic image forming equipment and, more particularly, to a positional relation between a transfer bias section and a discharge section with respect to a sheet and control over the transfer bias in an image transferring device of the type transferring an image from an image carrier to a transfer belt while conveying the sheet and causing it to electrostatically adhere to the belt. Further, the present invention relates to an image transferring device capable of obviating premature image transfer, print and the leak of transfer bias which will be discussed specifically.

It is a common practice with image forming equipment to use either a corona discharge type image transferring device or a contact type image discharging device. The corona discharge type device transfers a toner image from a photoconductive element, or image carrier, to a sheet by corona discharge applied to the rear of the sheet. The contact type device electrostatically transfers the toner image from the image carrier to a sheet carried on a transfer belt to which an electric field opposite in polarity to the toner image is applied. The contact type device usually includes an arrangement for applying a transfer bias to the transfer belt. For example, an electrode member is connected to a high-tension power source and held in contact with the rear of the belt at an image transfer position. Such an arrangement is advantageous over one which relies on corona discharge since it does not produce harmful ozone and can operate with a low voltage. Further, the contact type device reduces the size and cost of the equipment.

In addition to transferring a toner image from the photoconductive element to the sheet, the contact type device with the above-stated bias arrangement deposits a polarized charge on the sheet by the transfer bias so as to cause the sheet to electrostatically adhere to the belt. Therefore, as the belt is moved, the sheet can be conveyed by the belt and then separated from the belt due to the electrostatic adhesion.

However, when the sheet is caused to electrostatically adhere to the belt, it must be separated from the belt after image transfer. For the separation of the sheet, use may be made of a transfer belt having a resistance of $10^{10}\cdot\Omega\cdot$cm to $10^{13}$ Ω.cm, and a discharge member located downstream of an image transfer position with respect to an intended direction of movement of the belt for dissipating the charge of the belt, as taught in Japanese Patent Laid-Open Publication No. 63-83762 by way of example. The discharge member reduces or cancels the charge of the sheet to promote easy separation of the sheet. As to the discharging of the belt, Japanese Patent Laid-Open Publication No. 53-96838, for example, teaches an arrangement which uses a transfer belt having a resistance of $10^8$ Ω.cm to $10^{13}$ Ω.cm, and, in the event of continuously transferring images from a plurality of photoconductive elements to a sheet carried on the belt, dissipates a charge of the belt deposited by discharge ascribable to the separation of the sheet from one photoconductive element before the belt faces the next element.

On the other hand, when the transfer bias is maintained constant, a current to flow to the photoconductive element changes relative to the bias set at the transfer belt side due to changes in temperature, humidity and other environmental conditions. For example, in a high temperature and high humidity environment, an excessive current is apt to flow to the photoconductive element since the belt and sheet absorb moisture and lower their resistances. This increases the charge deposited on the photoconductive element and often causes the sheet to wrap around the element. In the converse environment, the transfer of a toner image becomes defective. In the light of this, use may be made of control circuitry having a controller for controlling the output current of a high-tension power source and to which a roller, supporting the belt, is connected, as taught in, for example, Japanese Patent Laid-Open Publication No. 3-231274. The control circuitry detects the output current of the power source by the support roller via the belt and controls the output current in matching relation to a feedback current flowing through the support roller. With such control circuitry, it is possible to maintain the current to flow to the drum constant and thereby prevent the sheet from wrapping around the drum while eliminating defective image transfer.

However, simply selecting an electric characteristic with regard to the belt is not satisfactory when the transfer bias or the discharging operation is to be set as stated above. Particularly, it is necessary to eliminate the wrapping of the sheet, defective image transfer and incomplete sheet separation by adequately positioning the constituents of the transferring device relative to each other and selecting adequate materials at the actual design stage. Moreover, for the control of the surface potential of the sheet via the belt, not only changes in environment but also other factors, e.g., changes in surface potential attributable to changes in resistance which are in turn ascribable to irregularities in the quality of belts particular to the production line and the size of an image must be taken into account. Should such changes be neglected, the amount of charge for setting up an electric field necessary for image transfer would change. This would not only degrade an image but also aggravate the defective sheet separation.

Japanese Utility Model Laid-Open Publication No. 5-18770 discloses an image transferring device having a transfer belt passed over two conductive rollers and held in contact with the image carrier. One of the rollers located upstream of the nip between the belt and the image carrier plays the role of a bias roller. A transfer bias is applied from a power source to the belt via the bias roller. The other roller is connected to ground. In this configuration, a toner image is transferred from the image carrier to a sheet conveyed to the nip by the belt. This type of device, however, has some problems yet to be solved, as follows. Before the sheet arrives at the nip, the toner image on the image carrier is partly transferred to the sheet, resulting in a blurred image. This will be referred to as premature transfer hereinafter. Furthermore, the toner transferred to the sheet by the premature transfer turns out a print due to the charge again applied from the bias roller at the nip. Specifically, the toner once transferred to the sheet is charged to the same polarity as the transfer bias and again transferred to the image carrier. Such premature transfer and print critically lower the quality of the resulting image on the sheet.

In another conventional image transferring device, a transfer roller is held in contact with the image carrier and applied with a transfer bias. When a sheet is fed to between the transfer roller and the image carrier, a toner image is transferred from the image carrier to the sheet by the transfer roller. In this type of device, a bias current fed from a power source to the transfer roller is maintained constant by PWM (Pulse Width Modulation) control executed by a constant current control section. For PWM control, the control section controls the bias current by using PWM pulses, senses the bias current, and updates the duty ratio of PWM pulses at a frequency matching the bias current. With this kind of scheme, it is possible to lower the bias voltage since the transfer roller directly contacts the image carrier without the intermediary of a transfer belt. However, the transfer bias is apt to leak when the bias voltage is raised, e.g., when a toner image is transferred to an OHP (OverHead Projector) sheet or similar high resistance sheet. Moreover, if the preselected frequency for updating the PWM pulse duty ratio and the preselected gain are inadequate, a periodic stripe pattern or so-called banding coincident with the updating frequency is likely to appear in an image, further lowering the image quality.

SUMMARY OF THE INVENTION

It is, therefore, an object of the present invention to provide an image transferring device for image forming equipment which insures desirable image transfer by eliminating premature transfer, print and the leak of transfer bias.

In accordance with the present invention, in image forming equipment having a movable image carrier, a latent image forming deivce for electrostatically forming a latent image on the image carrier, a developing device for developing the latent image to produce a corresponding toner image, and an image transferring device for transferring the toner image from the image carrier to a transfer medium, the image transferring device has a belt for causing the toner image to be transferred from the image carrier to the transfer medium while conveying it, a bias member for applying a charge opposite in polarity .to toner to the belt, a drive source for driving the belt, a feedback electrode through which a feedback current from the belt flows, and a constant current control section for executing constant current control such that a difference between a current to flow from the bias member to the belt and a feedback current to flow from the belt to the first feedback electrode remains constant. The bias member has a bias roller located downstream of a nip between the image carrier and the belt with respect to an intended direction of rotation of the belt.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
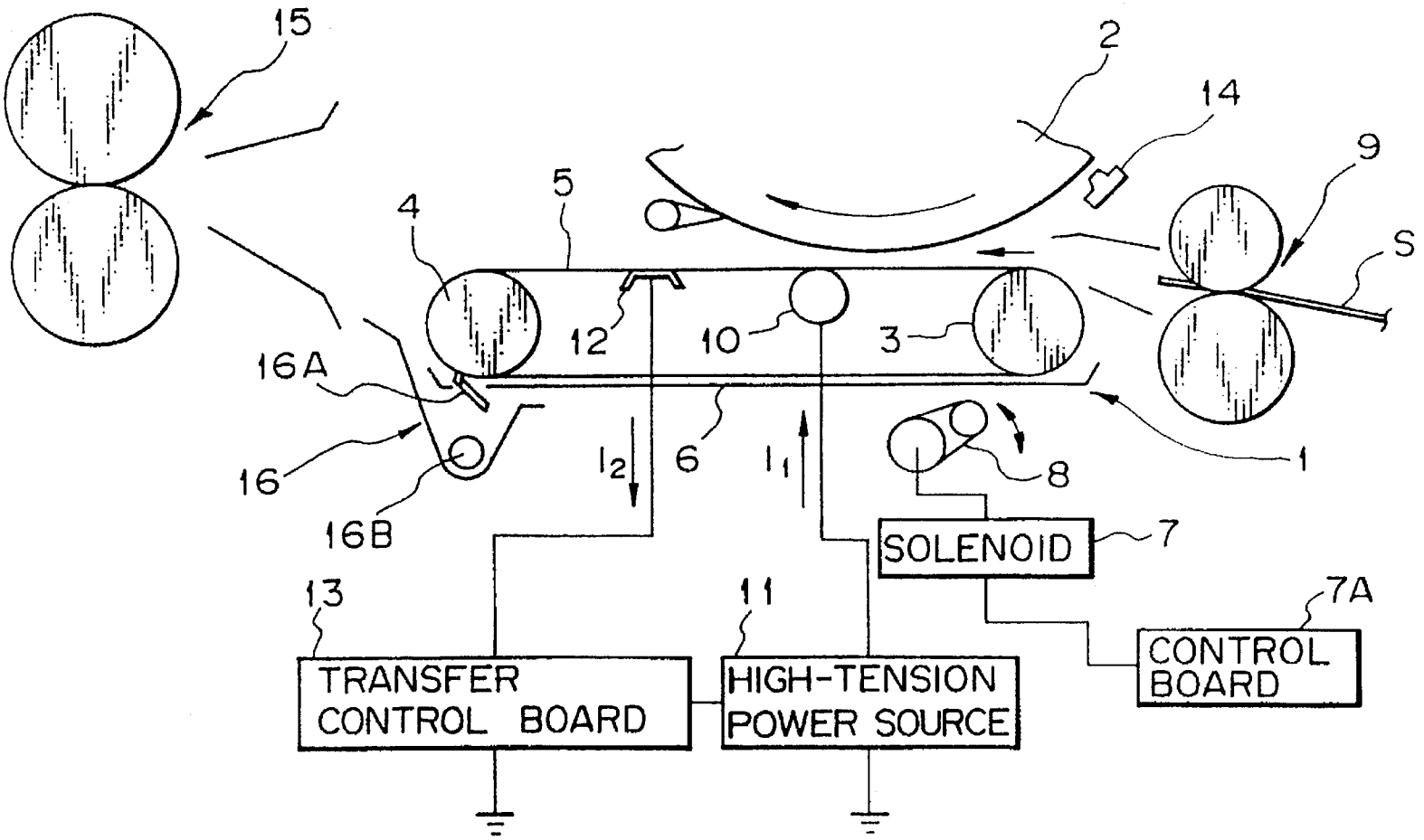
FIG. 1 is a section showing the general construction of an image transferring device embodying the present invention.
Figure 3:
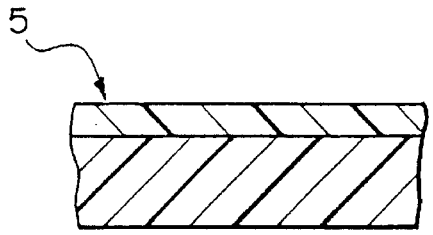
FIG. 3 is a section of a transfer belt included in the embodiment.

Referring to FIG. 1 of the drawings, an image transferring device for image forming equipment and embodying the present invention is shown and generally designated by the reference numeral 1. As shown, the device 1 has a transfer belt 5 passed over a pair of rollers 3 and 4. An image is formed on a photoconductive drum 2 and transferred to a sheet S carried on the belt 5. Specifically, as the roller, or drive roller, 4 is rotated, the belt 5 is moved in a direction for transferring the sheet S (indicated by an arrow in the figure) at a position where it faces the drum 2. As shown in FIG. 3, the belt 5 has a double layer structure, i.e., an outer or surface layer and an inner layer. The surface layer has an electric resistance of $1\times10^9$ Ωto $1\times10^{12}$ Ω as measured at the surface of the belt 5. The inner layer has a surface resistivity of $8\times10^6$ Ωto $8\times10^8$ Ω and a volume resistivity of $5\times10^8$·Ω·cm to $5\times10^8$ Ω·cm.

The rollers 3 and 4 are rotatably supported by a support 6. The support 6 is angularly movable about a position where it supports the drive roller 4 which is located downstream of a transfer position with respect to the direction of sheet feed. A solenoid 7 is operated by a control board 7A to actuate the side of the support 6 adjoining the transfer position side of the belt 5. Specifically, a lever 8 is connected to the solenoid 7 to move the support 6 into and out of contact with the drum 2. Sheet transporting means in the form of a registration roller 9 drives the sheet S toward the drum 2 in synchronism with an image formed on the drum 2. As the leading edge of the sheet S approaches the drum 2, the support 6 is moved toward the drum 2. As a result, the belt 5 is brought into contact with the drum 2 to form a nip B (see FIG. 2) where it can convey the sheet S while urging the sheet S against the drum 2.

In the illustrative embodiment, the roller 3 closer to the drum 2 than the roller 4 is implemented as a driven roller made of metal or similar conductive material having a relatively great electric capacity. The conductive driven roller 3 is held in a floating state to eliminate discharge ascribable to charge-up. In this configuration, charges deposited on the roller 3 are dissipated via the belt 5 having the above-stated electric characteristic. The surface of the roller 3 is tapered in the axial direction to prevent the belt 5 from becoming offset. The drive roller 4 is made of an insulating material in order to eliminate the sharp migration of charge which would cause discharge to occur in the event of separation of the sheet S from the belt 5, as will be described later specifically. For example, the roller 4 is made of insulating EP rubber or chloroprene rubber for the above purpose and, at the same time, for increasing the gripping force which the roller 4 exerts on the belt 5.

A bias roller 10 is located downstream of the driven roller 4 with respect to the moving direction of the belt 5 and held in contact with the inner surface or rear of the belt 5. Connected to a high-tension power source 11, the bias roller 10 constitutes a contact electrode for applying to the belt 5 a charge which is opposite in polarity to a toner deposited on the drum 2. A contact plate 12 is positioned downstream of the bias roller 10 in such a manner as to face the sheet S with the intermediary of one of opposite runs of the belt 5 corresponding to the sheet conveying surface of the belt 5. The contact plate 12 detects a current flowing through the belt 5 as a feedback current. The current to be fed from the bias roller 10 is controlled in response to the output of the contact plate 12. A transfer control board 13 is connected to the contact plate 12 to set a current to be applied to the bias roller 10 on the basis of the detected current. The transfer control board 13 is also connected to the high-tension power source 11.

Figure 2:
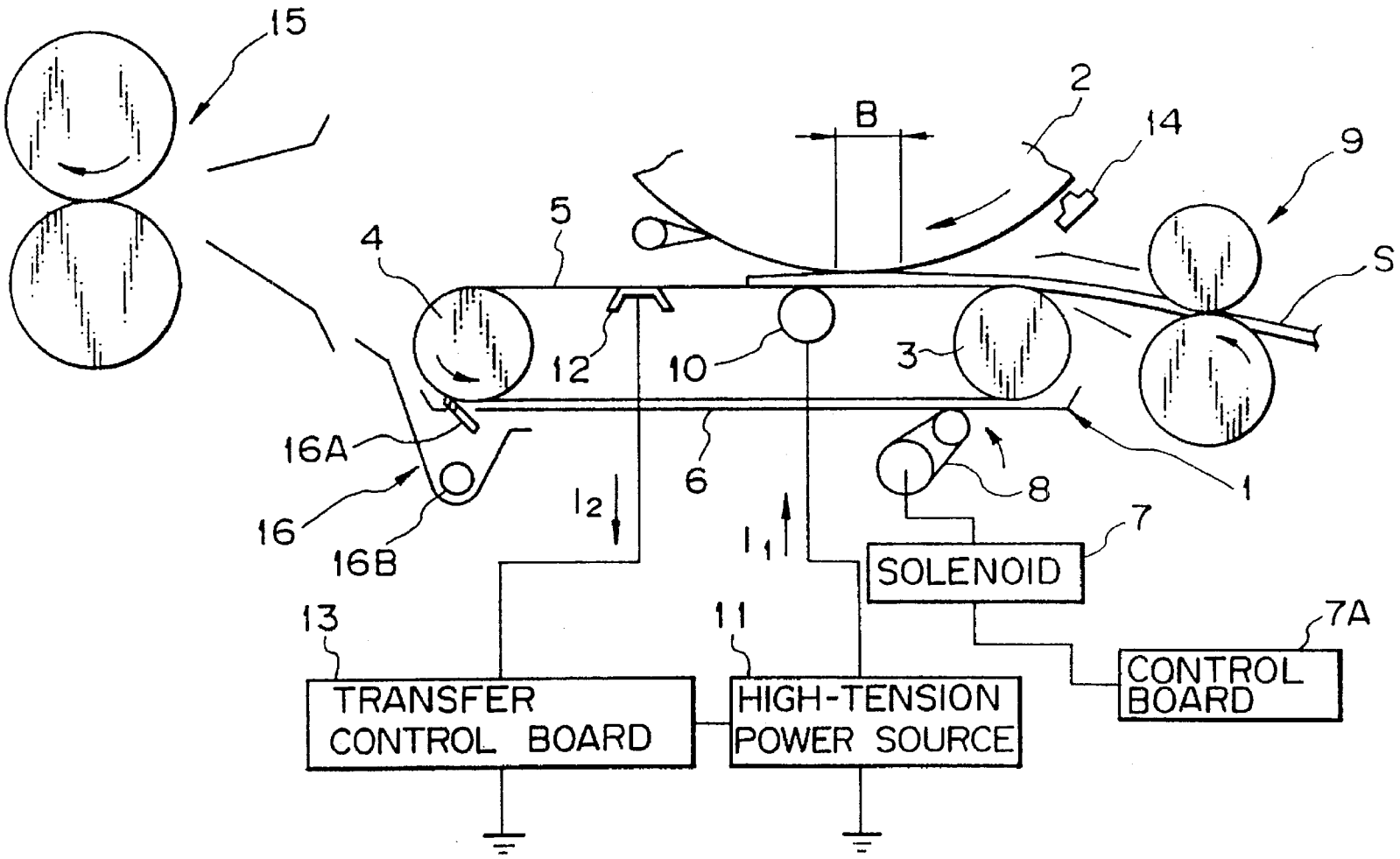
FIG. 2 demonstrates the operation of the embodiment for transferring an image.
Figure 4:
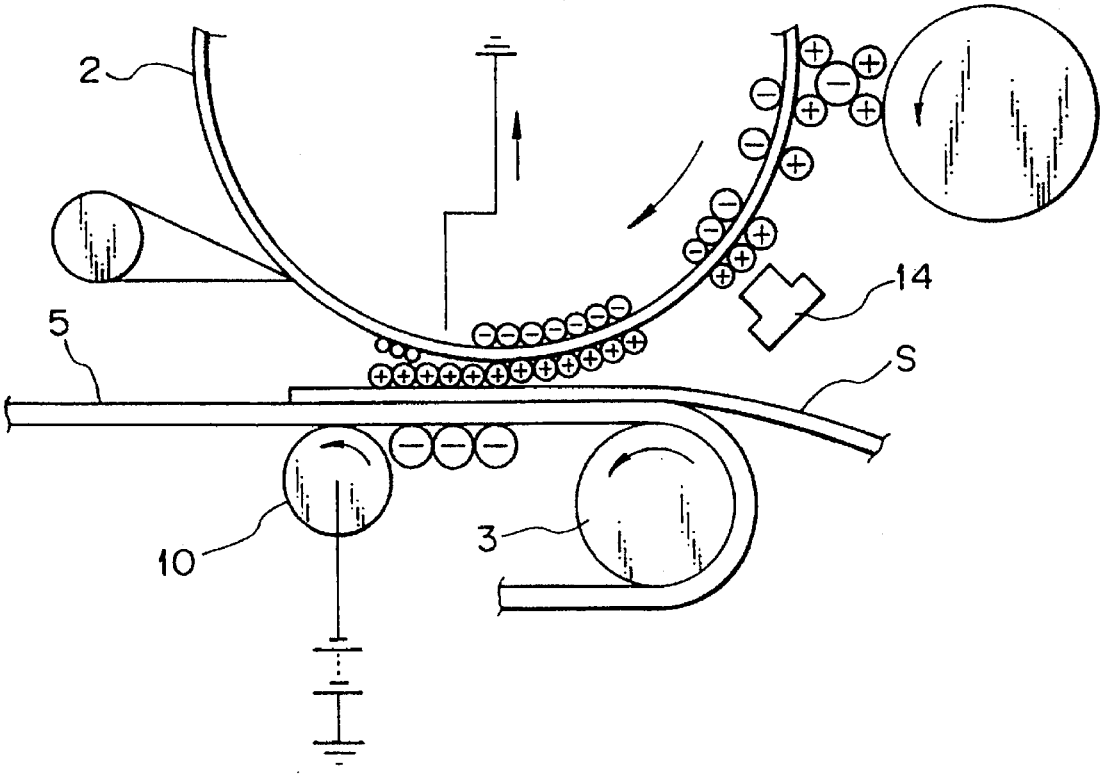
FIG. 4 is representative of a toner deposited on a photoconductive element included in the embodiment together with charges deposited on a sheet and the transfer belt for electrostatically transferring the toner.

In operation, as the sheet S is fed from the registration roller 9, the support 6 and, therefore, the belt 5 is angularly moved toward the drum 2. Then, the belt 5 forms the nip B between it and the drum 2, as shown in FIG. 2. The nip B is dimensioned about 4 mm to about 8 mm in the direction of sheet transport. On the other hand, the drum 2 has the surface thereof charged to, for example, −800 V and electrostatically carries toner thereon, as shown in FIG. 4. Before such a surface of the drum 2 reaches the nip B, the surface potential is lowered by a pretransfer discharge lamp 14. In FIG. 4, the size of a charge is represented by the diameter of a circle; charges lowered by the lamp 14 are represented by smaller circles. At the nip B, the toner on the drum 2 is transferred to the sheet S by the bias from the bias roller 10. In the embodiment, a voltage of −1.5 kV to −2.0 kV is applied to the bias roller 10, so that the potential of the belt 5 may range from −1.3 kV to −1.8 kV as measured at the nip B.

The above-mentioned potential of the belt 5 at the nip B is selected for the following reason. In FIGS. 1 and 2, assume that the output current of the power source 11 is $I_1$, and that the feedback current flown from the contact plate 12 to ground via the belt 5 is $I_2$. Then, the current $I_1$ is controlled to satisfy an equation:

$$I_1 - I_2 = I_{OUT} \quad \text{Eq. (1)}$$

where $I_{OUT}$ is constant. This successfully stabilizes the surface potential $V_P$ of the sheet S and, therefore, eliminates changes in transfer efficiency without regard to temperature, humidity and other environmental conditions or irregularities in the quality of belts 5. More specifically, by considering that a current $I_{OUT}$ flows toward the drum 2 via the belt 5 and sheet S, it is possible to prevent the sheet separability and image transferability from being effected by changes in the easiness of current flow to the drum 2 which are ascribable to a decrease or an an increase in the surface potential $V_P$ of the sheet S.

As stated above, the potential of the belt 5 at the nip B is so set as to obtain the surface potential $V_P$ of the sheet S. In this connection, favorable image transfer was achieved when the $I_{OUT}$ was 35 μA plus 5 μA. It is to be noted that regarding the above-stated potential range of "−1.3 kV to −1.8 kV" of the belt 5, the surface potential of the sheet S may sometimes exceed the range, depending on the environment, the kind of sheet and/or the change in the resistance of the belt 5.

When an image is transferred from the drum 2 to the sheet S, the sheet S is also charged. Therefore, the sheet S can be electrostatically attracted by the belt 5 and thereby separated from the drum 2 on the basis of the relation between the true charge on the belt 5 and the polarized charge on the sheet S. This is enhanced by the size of the transfer bias (higher than −3 kV) relative to the charge potential (−800 V) of the drum 2 and by, apart from the electrostatic relation, the elasticity of the sheet S using the curvature of the drum 2.

However, the electrostatic adhesion relying on potential described above is not satisfactory since in a highly humid environment a current easily flows to the drum 2 to obstruct the separation of the sheet S. In the light of this, the surface layer of the belt 5, FIG. 2, is provided with a relatively high resistance so as to delay the shift of the true charge from the belt 5 to the sheet S at the nip B and, therefore, the flow of a current to the drum 2. In addition, the bias roller 10 is located downstream of the nip B in the direction of sheet transport. With this configuration, it is possible to obviate the electrostatic adhesion of the sheet S and drum 2. To delay the shift of the true charge means to prevent a charge from depositing on the sheet S before the sheet S reaches the nip B. Hence, the sheet S is prevented from wrapping around the drum 2 or from being incompletely separated from the drum 2.

Also, the belt 5 should preferably be made of a material whose resistance is sparingly susceptible to changes in environment. For example, when the belt 5 is implemented as an elastic belt made of rubber, chloroprene or similar material having low hygroscopic property and stable resistance is more desirable than, for example, urethane rubber which is highly hygroscopic.

The current $I_{OUT}$ to flow to the drum 2 is not unconditionally selected. For example, the current $I_{OUT}$ may be reduced when the potential of the toner is low as in a digital system. Conversely, when the pretransfer discharge lamp is not used, the current $I_{OUT}$ may be increased in matching relation to an increase in the surface potential of the drum 2.

The sheet S passed through the nip B is conveyed by the belt 5. During the conveyance, the electrostatic adhesion between the sheet S and the belt 15 is reduced or cancelled by the discharge effected by the contact plate 12. At this instant, the rate or speed at which the charge deposited on the sheet S is reduced is dependent on the resistance of the sheet S and the electrostatic capacity. Specifically, assuming that the resistance of the sheet is R while the electrostatic capacitance is C, the rate is expressed as:

$$\tau(\text{time constant}) = C \cdot R \quad \text{Eq. (2)}$$

Hence, when the sheet S is implemented as an OHP sheet or has the resistance thereof increased due to high humidity, a substantial period of time is necessary for the charge deposited thereon to decrease. Such a sheet S is separated from the belt 5 by the curvature of the drive roller 4. For this purpose, the drive roller 4 is provided with a diameter less than 16 mm. Experiments showed that when use was made of such a drive roller, a high quality 45K sheet (rigidity: horizontal 21 ($cm^3$/100)) could be separated.

After the image transfer from the drum 2 to the sheet S and the separation of the sheet S, the solenoid 7 is deenergized to release the support 6 from the drum 2. Then, the surface of the belt 5 is cleaned by a cleaning device 16 having a blade 16A. The blade 16A rubs the surface of the belt 5 to scrape off the toner transferred from the background of the drum 2 to the belt 5, the toner scattered around the belt 5 without being transferred, and paper dust separated from the sheet S. The belt 5 to be rubbed by the blade 16A is provided with a coefficient of friction low enough to eliminate an increase in required torque due to an increase in frictional resistance and to eliminate the deformation of the blade 16A. Specifically, in the embodiment, the surface of the belt 5 is covered with fluorine (vinylidene polyfluoride). The toner and paper dust removed from the belt 5 by the blade 16A are collected in a waste toner container, not shown, by a coil 16B.

The various members for setting the surface potential of the sheet S as described above are related in position, as follows. To begin with, assuming that the current $I_{OUT}$ is constant, a change in the current $I_1$ to the bias roller 10 causes the output voltage $V_O$ of the power source 11 to change, as indicated by the Eq. (1). Assume that when the output voltage $V_O$ has a maximum value $V_{max}$, the distance from the driven roller 3 to the nip B is $L_1$ while the output voltage $V_O$ is applied to the bias roller 10. Then, the distance $L_1$ is so selected as to satisfy a relation:

$$L_1 \geqq a \times |V_O| \qquad \text{Eq. (3)}$$

where a is 1.0 (mm/kV). Further, assuming that the distance from the nip B to the bias roller 10 is $L_2$, then the distance $L_2$ is determined to satisfy a relation:

$$L_2 \geqq a \times |VO| \qquad \text{Eq. (4)}$$

where $\alpha$ is 1.0 (mm/kV).

Why the distances $L_1$ and $L_2$ are selected as stated above is as follows. Assume that the belt 5 is a dielectric body having the time constant $\tau$. Then, as the bias roller 10 approaches the drum 2, e.g., reaches a position just below the drum 2 while the output voltage $V_O$ is high, dielectric breakdown is apt to occur in a conductor included in the drum 2. The distances $L_1$ and $L_2$ successfully obviate such an occurrence. Specifically, assuming that $L_1=L_2=1$ mm and $V_O=-3$ kV, then a leak occurs from the bias roller 10 to the drum 2 over the gap. The leak occurs at, for example, micropores and comparatively thin portions which may exist in the belt 5. The leak breaks the portion where it occurred, i.e., it forms micropores in the surface of the belt 5 and that of the drum 2. As a result, power for forming an electric field for image transfer is not used and, therefore, the electric field is not formed, making the image transfer defective. Moreover, spark discharge ascribable to the leak is not desirable from the safety standpoint. This is also true with the driven roller 3 held in a floating state.

For the reasons described above, the embodiment selects $V_{max}$ of −3 kV and distances $L_1$ and $L_2$ of 8 mm and 6 mm, respectively. It is to be noted that the value $\alpha$ is variable in matching relation to the output voltage $V_O$ and may be 2 or above.

Assuming that the distance from the bias roller 10 to the contact plate 12 is $L_3$, then the distance $L_3$ is related to the distance $L_2$, as follows:

$$L_3 \leqq L_2$$

This is because, to achieve $I_{OUT}$ efficiently, the distance $L_3$, i.e., the resistance of the belt 5 per unit area should be great enough to distribute $I_1$ in a relation of $I_{OUT}>I_2$. Specifically, assuming that the feedback current $I_2$ is zero, i.e., the contact plate 12 is absent, $I_1$ will be equal to $I_{OUT}$, providing 100% efficiency. However, since the entire surface of the belt 5 will have exactly the same potential as the output voltage $V_O$, electric noise will occur at the positions where the rollers contact the belt 5 and effect the control system to bring about errors.

Hence, a relation $I_1=I_{OUT}+I_2$ is derived from the previously stated relation $I_1-I_2=I_{OUT}$.

It will be seen from the above that the power source current ($I_1$) is determined by the sum of $I_{OUT}$ and $I_2$ and, therefore, $I_2$ should be as small as possible in order to use the power source for the image transfer purpose as efficiently as possible. On the other hand, when the resistance of the belt 5 remains the same, the current distribution is inversely proportional to the distances $L_2$ and $L_3$. Therefore, a relation $L_3 \geqq L_2$ should hold as far as possible. When an experiment was conducted with a relation $L_3>L_2$, the capacity of the power source and, therefore, the image transfer was found short. Further, since the power source is often built in a unit, the capacity thereof, i.e., the space for accommodating it cannot be increased beyond a certain limit. In this respect, too, the contact plate 12 for controlling the potential of the belt 5 and the above-mentioned positional relation are indispensable.

Figure 5:
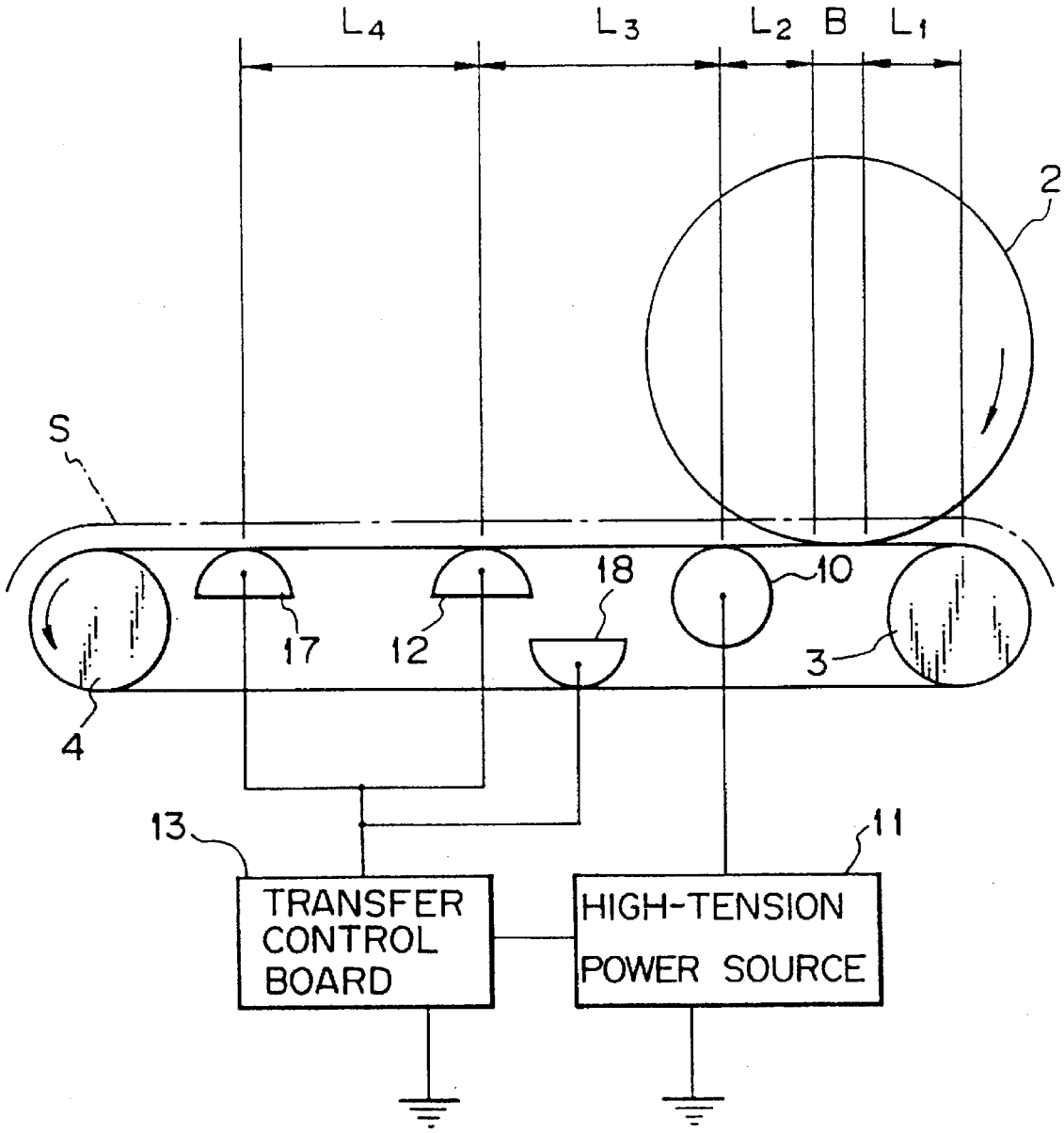
FIG. 5 is indicative of a positional relation of a driven roller, a bias roller and contact plates included in the embodiment.

As shown in FIG. 5, a second contact plate 17 may be located downstream of the contact plate 12 in the direction of sheet transport. In such a case, the contact plates 12 and 17 are spaced apart by a distance $L_4$ which insures the discharge of the belt 5 having the time constant $\tau=C \cdot R$. The distance $L_4$ depends on the process speed v of the belt 5 and is selected to satisfy a relation:

$$\tau \leqq L_4/v$$

In this case, $\tau$ indicates a period of time necessary for the belt 5 to be discharged, as counted from the time when the belt 5 has moved away from the first contact plate 12.

Specifically, considering the separation of the sheet from the belt 5, it is necessary to surely discharge the belt 5. When the belt 5 moved away from the second contact plate 17 is not fully discharged, the discharge of the belt 5 over the distance from the contact plate 17 and the separation position solely depends on the time constant of the belt 5. Therefore, only if the discharge depending on the time constant of the belt 5 is completed when the belt 5 has moved clear of the contact plate 17, the belt 5 will be fully discharged. Such a relation is also desirable when the linear velocity (process speed) of the belt 5 is taken into account.

Figure 6:
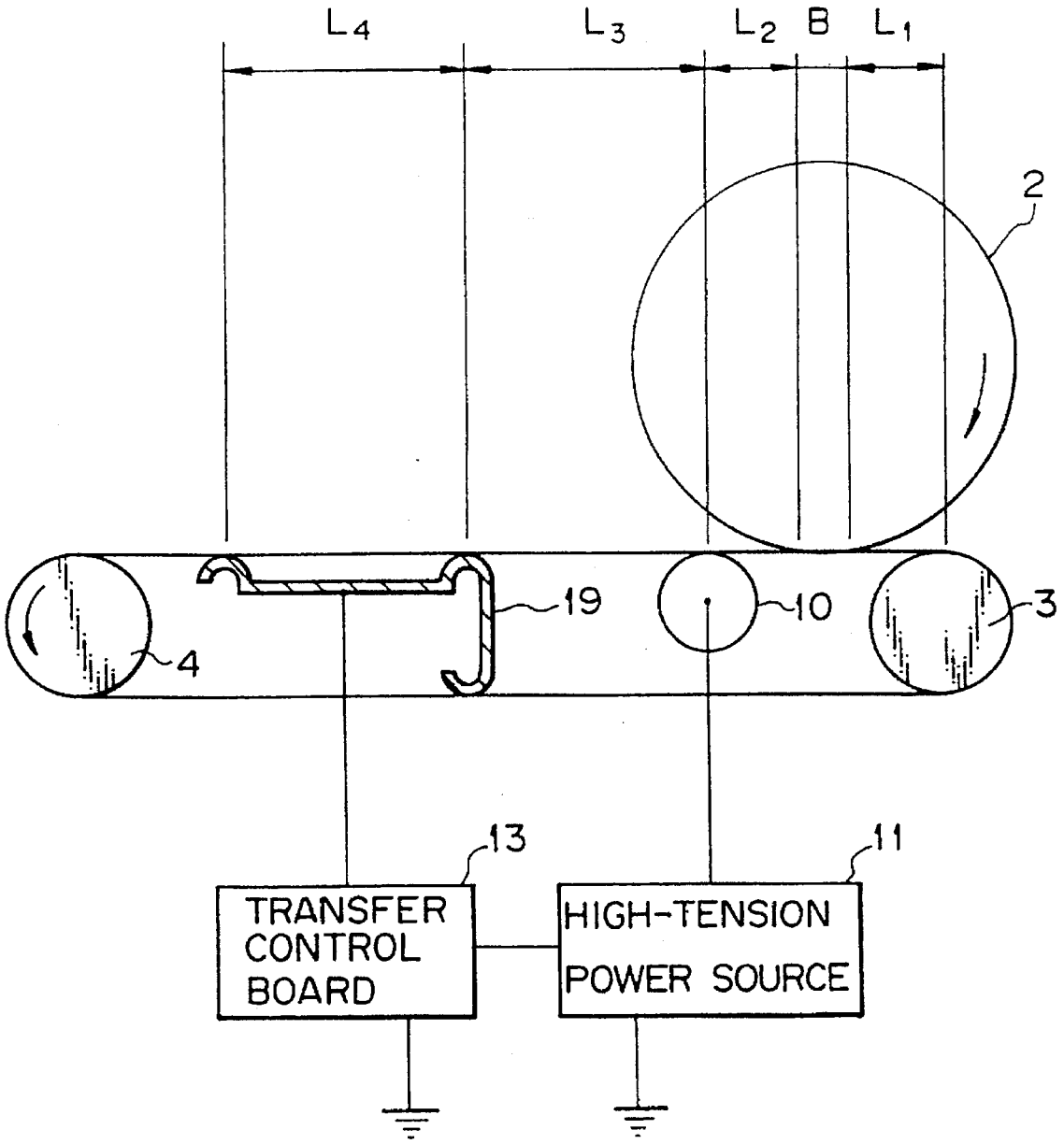
FIG. 6 shows a modified configuration of the contact plates of FIG. 5.
Figure 7:
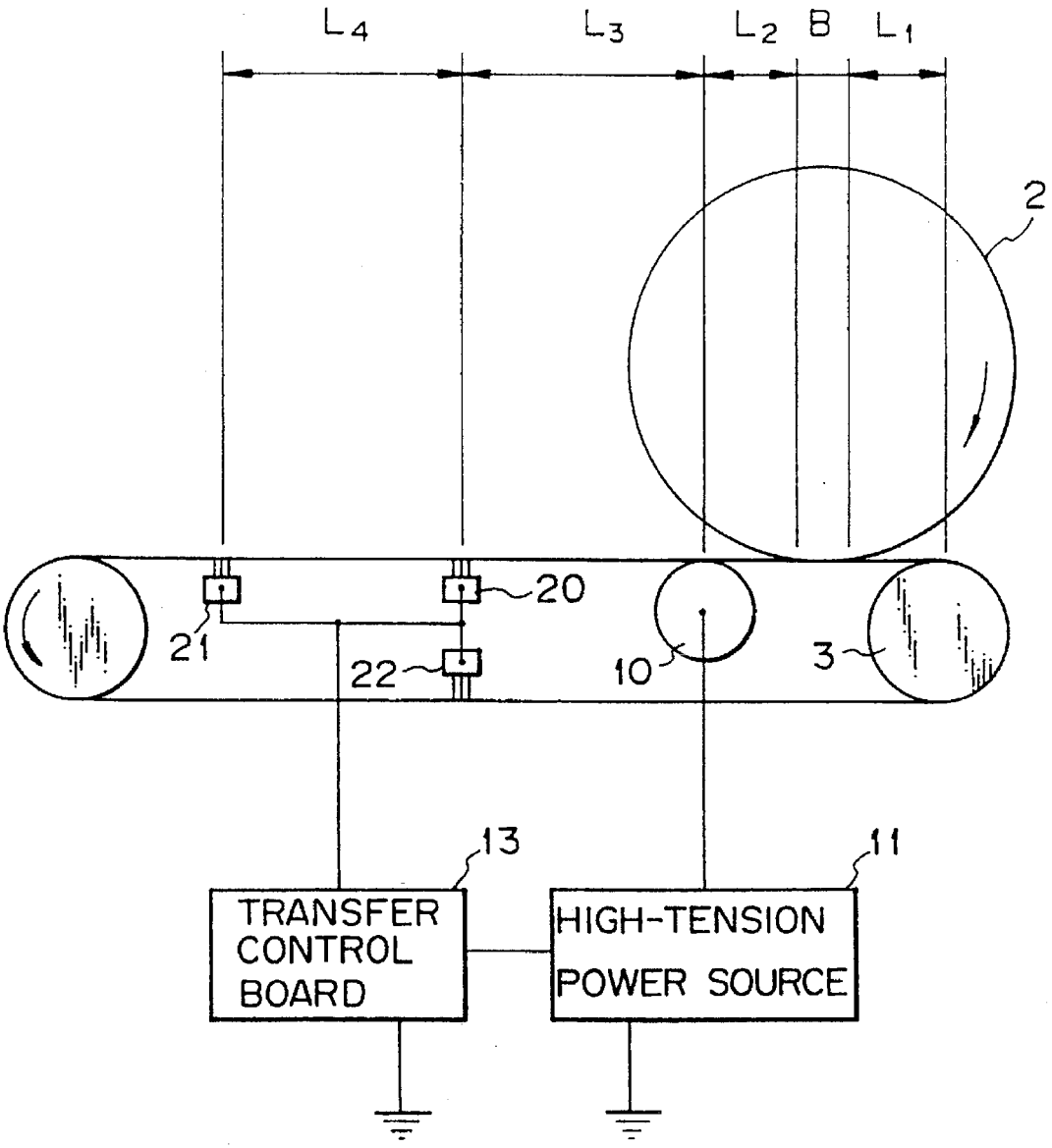
FIG. 7 shows another specific configuration of the contact plates of FIG. 5.

As also shown in FIG. 5, a third contact plate 18 may be held in contact with the inner surface of the lower run of the belt 5 which is opposite to the upper run for carrying the sheet S. The contact plate 18 functions in the same manner as the other contact plates 12 and 17. As shown in FIG. 6, the contact plates 12, 17 and 18 may be implemented as a single contact member 19 formed of sheet metal, if desired. Further, as shown in FIG. 7, the contact plates 12, 17 and 18 may be respectively constituted by conductive brushes 20, 21 and 22 in order to reduce the contact resistance.

A reference will be made to FIGS. 8–14 for describing specific arrangements for preventing the current to flow to the photoconductive element from changing due to a change in the resistance of the transfer belt, a change in the property of the sheet, etc.

Figure 8:
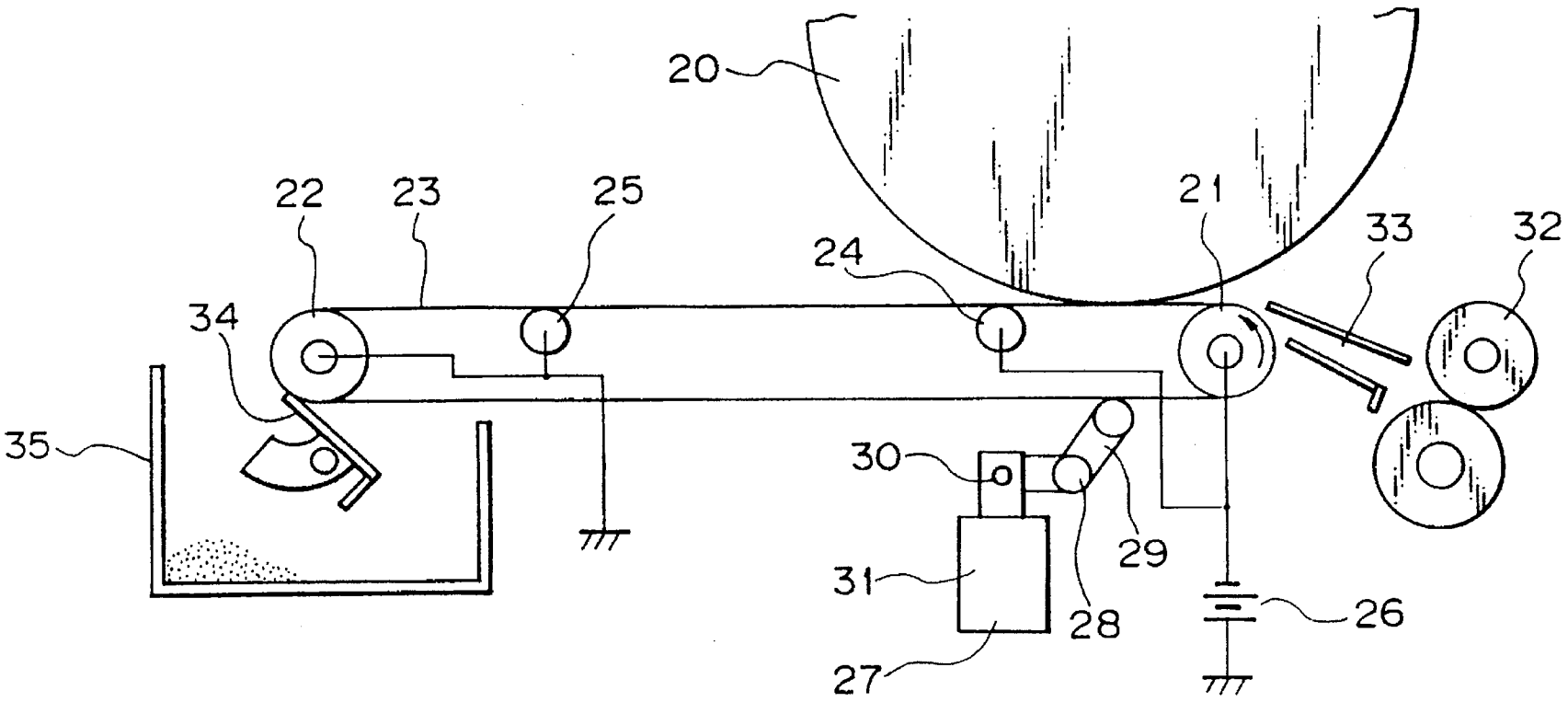
FIG. 8 shows a specific arrangement for maintaining a difference between a current to flow to the transfer belt and a current to flow to ground constant.

In FIG. 8, a photoconductive drum, or image carrier, 20 is rotatable. Arranged around the drum 20 are a discharger for discharging the drum 20, a charger for charging the drum 20, an exposing section for forming an electrostatic latent image on the drum 20 by light, a cleaning unit for cleaning the drum 20 and other conventional process units, although not shown in the figure. A transfer belt 23 is disposed below the drum 20 and passed over a conductive drive roller 21 and a conductive driven roller 22. The upper run of the belt 23 is supported by conductive rollers 24 and 25 from the rear. The drive roller 21 is connected to a motor, not shown, and rotated in a direction indicated by an arrow in the figure. The rollers 21 and 24 are connected to a power source 26 to play the role of contact electrodes contacting the belt 23. The roller or contact electrode 24 is located downstream of a nip between the drum 20 and the belt 23 with respect to an intended direction sheet transport. Specifically, the roller 24 is positioned such that a charge is not injected into a sheet before the sheet reaches a position where it faces the drum 20, as in the arrangement of FIG. 1. Again this successfully prevents a sheet from wrapping around the drum 20. The other rollers 22 and 25 are connected to ground. The belt 23 is formed of a dielectric material having a resistance of $10^6$ Ω to $10^{12}$ Ω, particularly $9\times10^7$ Ω to $9.4\times10^7$ Ω in the embodiment.

The belt 23 is selectively brought into or out of contact with the drum 20 by a mechanism 27 including a lever 29 and a solenoid 31. The lower end of the lever 29 is rotatably connected to a plunger 30 extending out from the solenoid 31. The lever 29 supports the belt 23 at the upper end thereof and is rotatable about a shaft 28. A sheet guide 33 extends from a register roller, or sheet transporting means, 32 to the drive roller 21. A cleaning blade 34 is disposed in an open-top waste toner container 35 and urged against the driven roller 22 with the intermediary of the belt 23 to remove a toner remaining on the belt 23.

Figure 9:
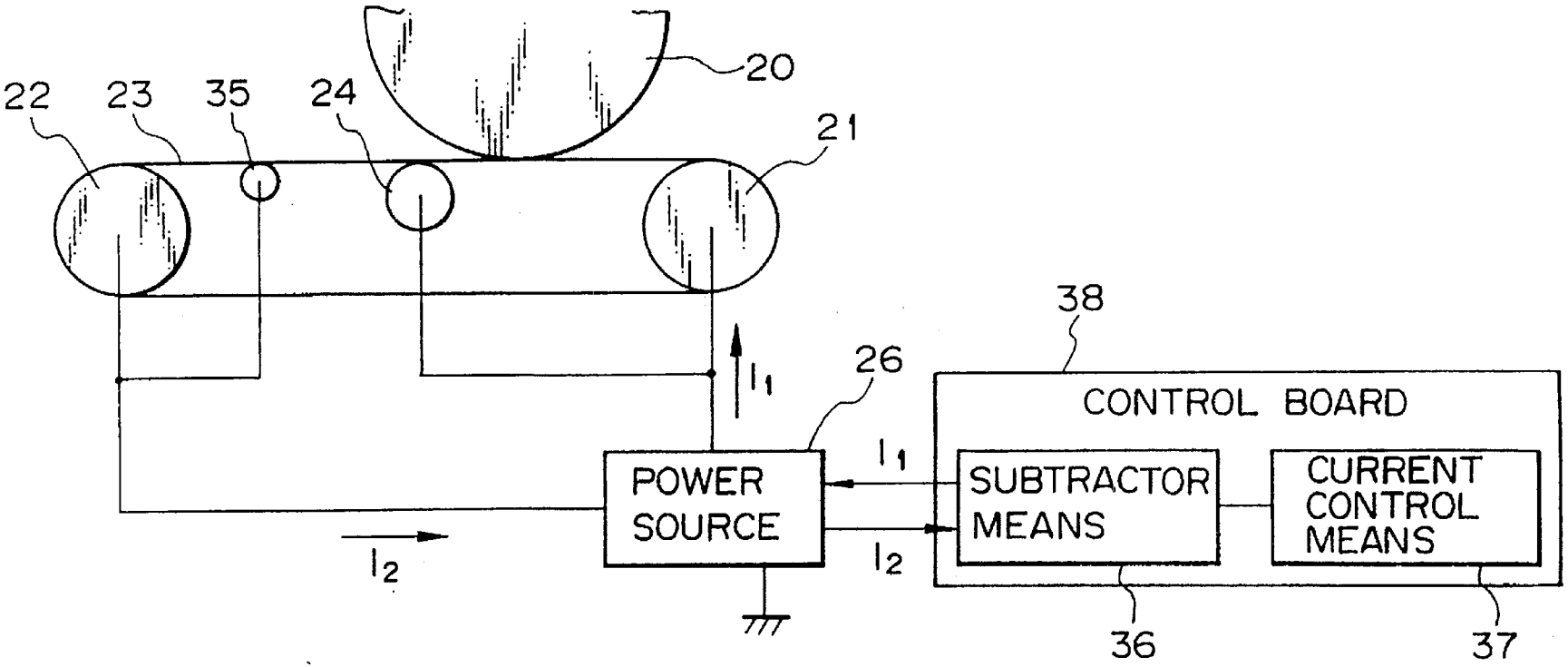
FIG. 9 is a schematic block diagram associated with FIG. 8.

As shown in FIG. 9, assume that a current $I_1$ is fed from the power source 26 to the belt 23 via the drive rollers or contact electrodes 21 and 24, and that a current $I_2$ flows from the belt 23 to ground via the rollers 22 and 25. A control board 38 includes a subtracter means 36 and a current control means 37. The subtracter means 36 subtracts the current $I_2$ from the current $I_1$. The control means 37 controls the current from the power source 26 to the rollers 21 and 24 such that the residual produced by the subtracter means 36 remains constant, i.e., at 30 μA in this case.

In operation, a sheet, not shown, is brought to a stop by the registration roller 32 and then driven to the nip between the drum 20 and the belt 23 in synchronism with the rotation of the drum 20. At this instant, the solenoid 31 is energized to cause the lever 29 to bring the belt 23 into contact with the drum 20. In FIG. 9, a current is fed from the power source 26 to the dielectric belt 23 via the rollers 21 and 24 while the belt 23 is driven by the roller 21 to transport the sheet to the left. Since the belt 23 has a resistance of $9\times10^7$ to $9.4\times10^7$ Ω, as stated earlier, the current is prevented from immediately flowing to ground. Hence, a charge necessary for image transfer can be deposited on the belt 23 in the vicinity of the drum 20. In addition, the current control means 37 controls the current to the belt 23 such that the difference between the current $I_1$ to the belt 23 and the current $I_2$ to ground remains constant, as also stated previously. It follows that although the resistance of the belt 23 may change, the current to flow from the belt 23 to the drum 20 remains constant to in turn maintain the charge necessary for image transfer substantially constant between the drum 20 and the belt 23. As a result, the quality of a transferred image is enhanced.

Figure 10:
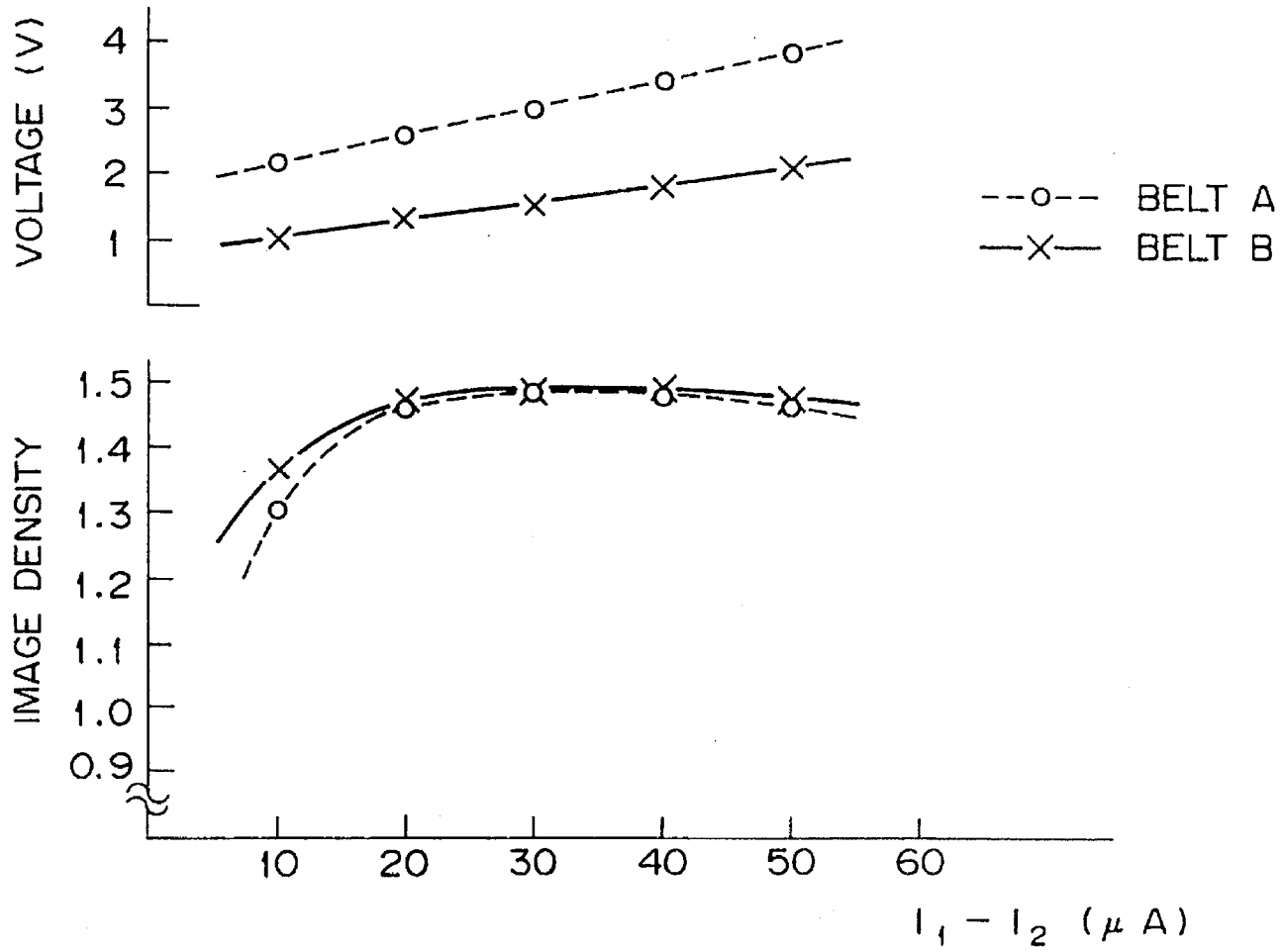
FIG. 10 plots a relation between a current and a voltage and image density with respect to different transfer belts and particular to the arrangement of FIG. 8.
Figure 11:
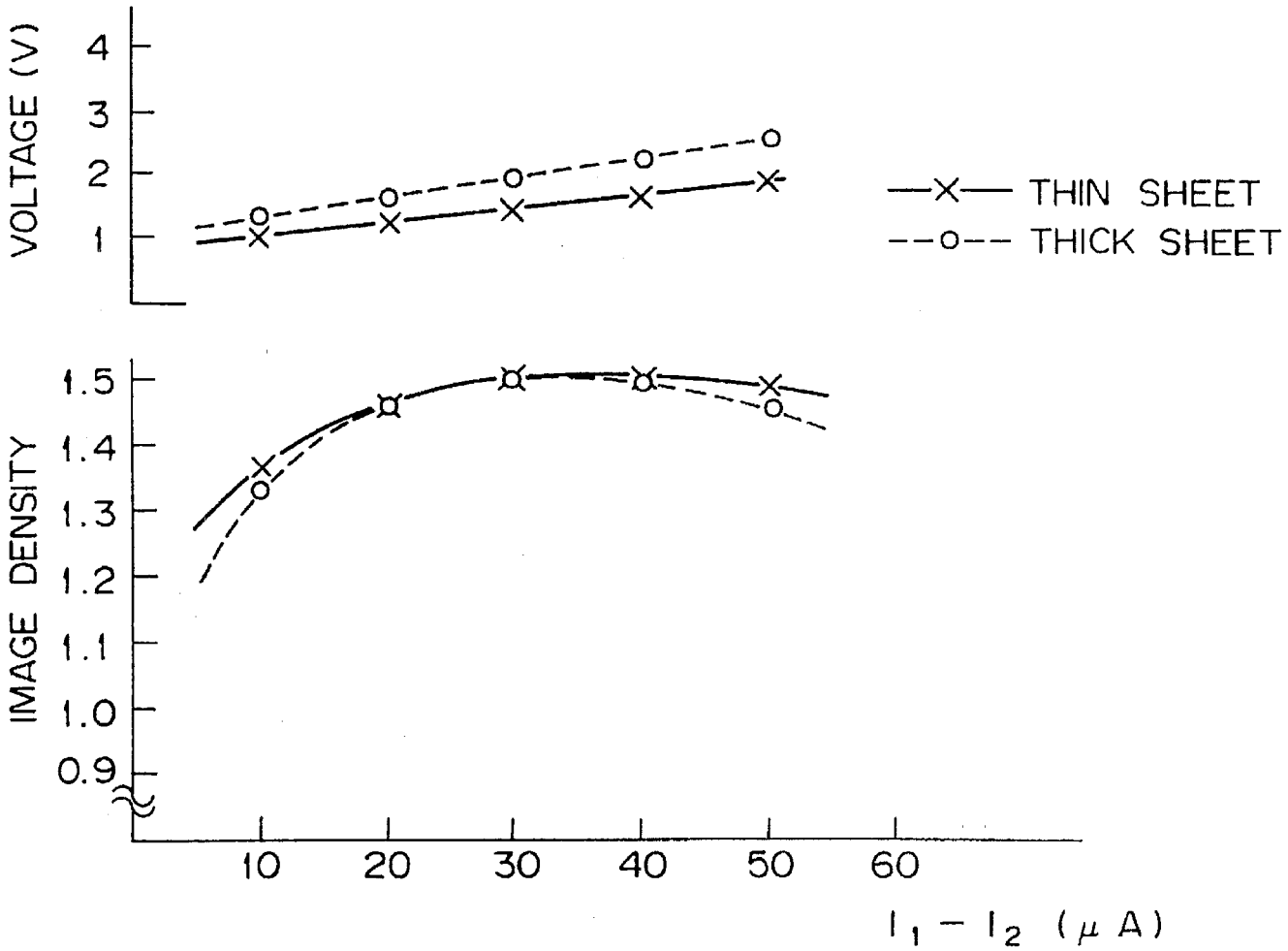
FIG. 11 plots a relation between a current and a voltage and image density with respect to different sheets and also particular to the arrangement of FIG. 8.
Figure 12:
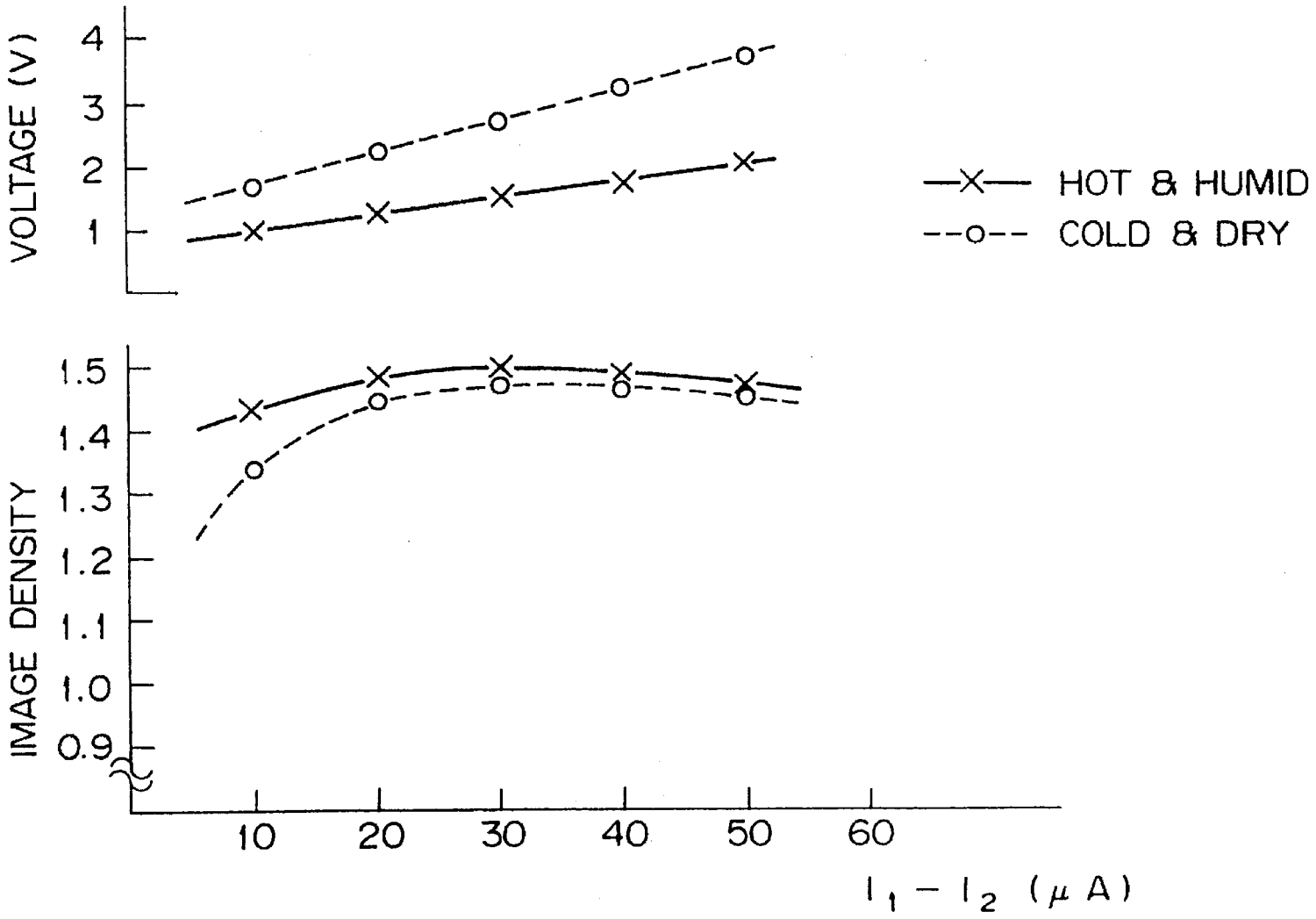
FIG. 12 plots a relation between a current and a voltage and image density with respect to different environments and also particular to the arrangement of FIG. 8.

FIGS. 10–12 show experimental data for supplementing the above description of the operation. In the figures, the abscissa and the ordinate indicate respectively the difference between the currents $I_1$ and $I_2$ and the voltage applied to the belt 23 together with image density. Specifically, in FIG. 10, dotted curves and solid curves respectively indicate data derived from belts A and B each having a particular resistance.

FIG. 11 is indicative of a relation between the difference between the currents $I_1$ and $I_2$ and the voltage and image density. Solid curves and dotted curves are respectively associated with a thin sheet and a thick sheet each having a particular conductivity characteristic.

FIG. 12 shows a relation between the difference between the currents $I_1$ and $I_2$ and the voltage and image density with respect to different environments. Solid curves and dotted curves are respectively associated with a high temperature and high humidity environment and a low temperature and low humidity environment.

The driven roller 22 is provided with a diameter as small as about 14 mm to 16 mm, as stated earlier. Hence, the sheet carrying an image transferred from the drum 20 and being transported by the belt 23 is separated from the belt 23 due to its own elasticity and then driven out to the left. The separation of the sheet from the belt 23 is further enhanced since, as the sheet moves away from the drum 20, the charge on the belt 23 is dissipated due to the conductivity of the belt 23. When the sheet moves away from the nip of the drum 20, the solenoid 31 is deenergized to lower the lever 29. As a result, the belt 23 is moved away from the drum 20 to protect the drum 20 from deterioration.

If desired, a particular voltage range which the power source 27 can apply may be preselected, and means for detecting a change in the voltage may be provided. Then, when the voltage is brought out of the particular range, alarm means, not shown, may produce an alarm. Specifically, when a leak occurs at a location other than between the power source 26 and the associated member or when the current fails to flow to the belt 23, the detecting means will detect such an occurrence and cause the alarm means to produce an alarm.

Figure 13:
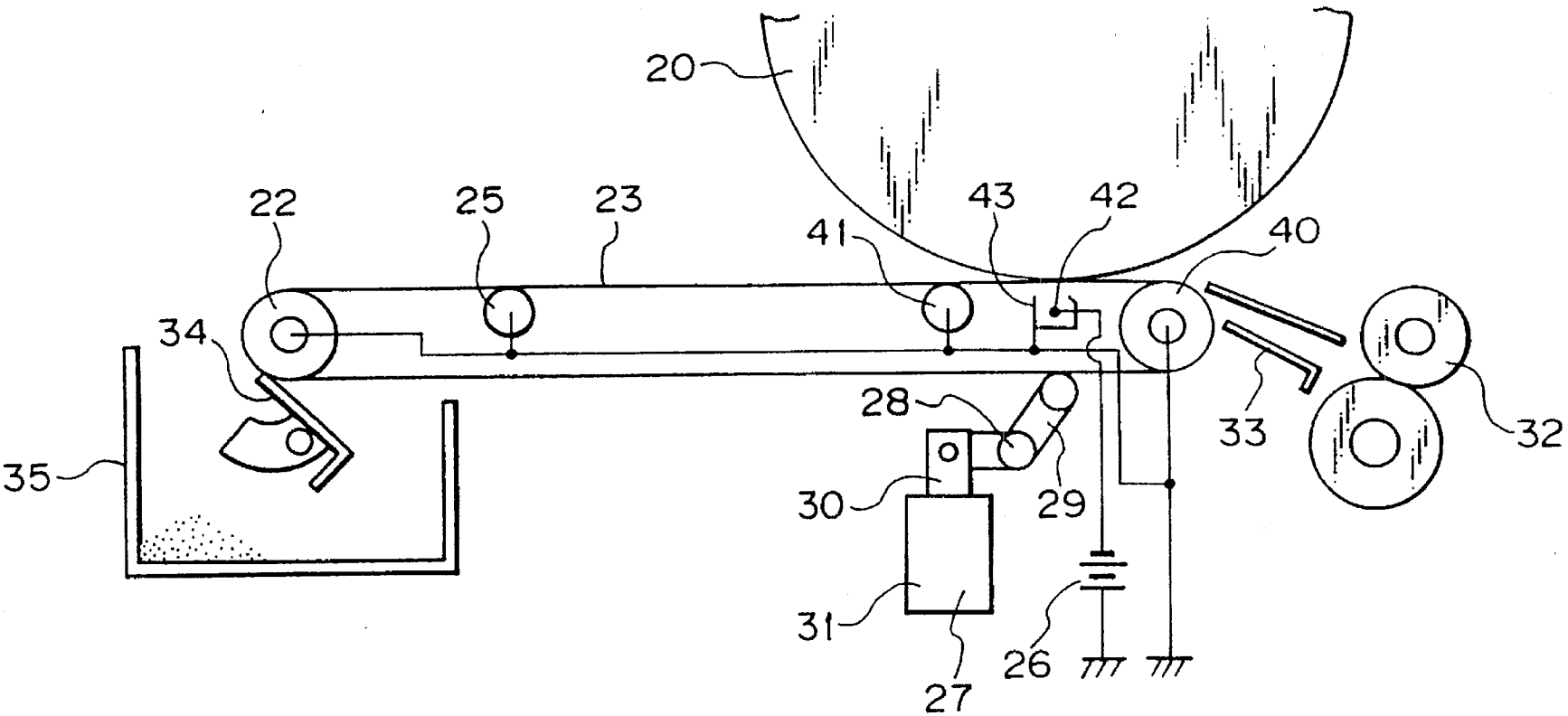
FIG. 13 is a section showing a modification of the arrangement of FIG. 8.

FIG. 13 shows a structure using a corona charger 42 for charging the belt 23. As shown, the belt 23 is driven by a driven roller 40. A roller 41 supports the belt 23 in the vicinity of the drum 20. The rollers 40 and 41 are made of a conductive material and connected to ground together with the driven roller 22 and roller 25. The corona charger 42 faces the inner surface of the belt 23 immediately below the drum 20 and has a wire and a casing 43. The wire is connected to the power source 26 while the casing 43 is connected to ground.

Figure 14:
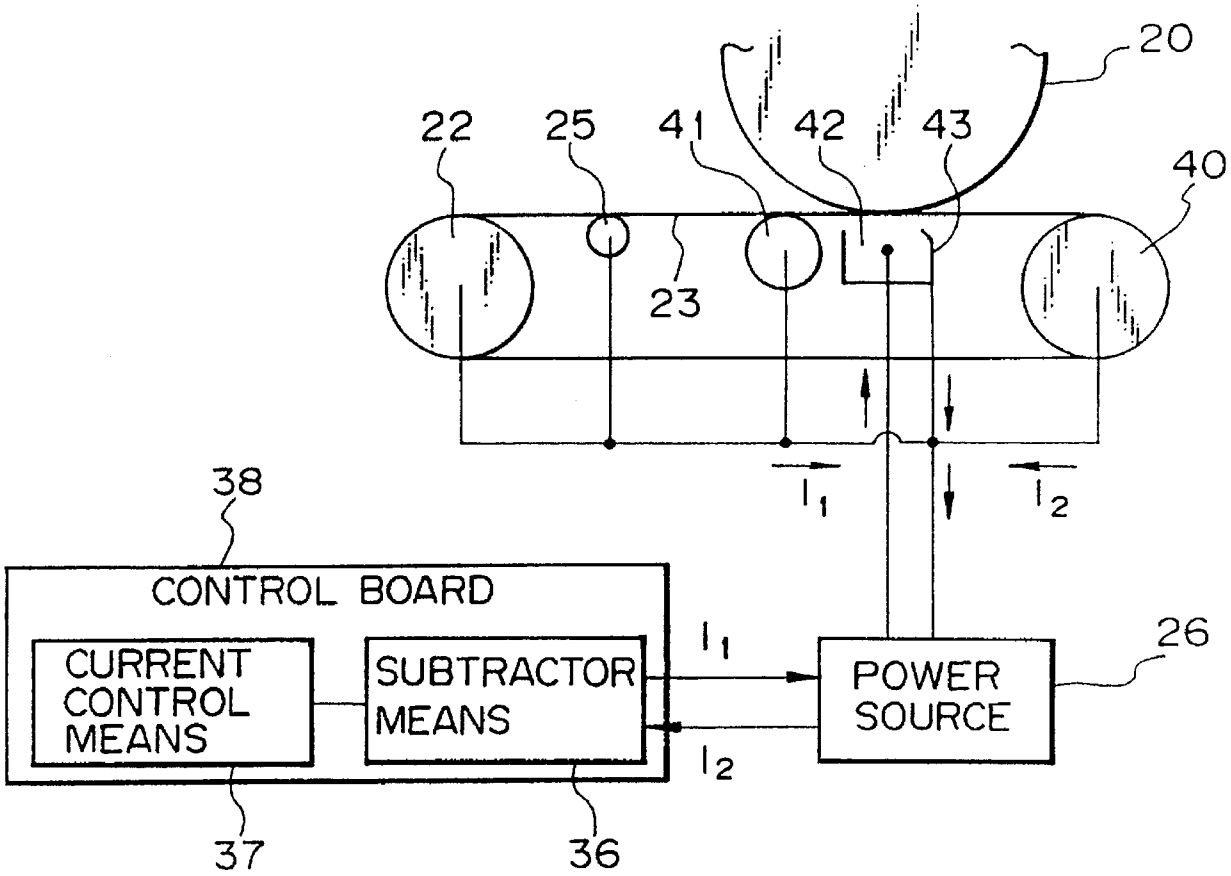
FIG. 14 is a schematic block diagram associated with FIG. 13.

As shown in FIG. 14, assume that a current $I_1$ is fed from the power source 26 to the wire of the corona charger 42, and that the sum of the current to flow from the casing 43 to ground and the current to flow from the belt 23 to ground via the rollers 22, 25, 40 and 41 is $I_2$. The control board 38 has the subtracter means 36 for subtracting $I_2$ from $I_1$, and the current control means 37 for controlling the current from the power source 26 to the corona charger 42 such that the residual remains constant (30 μA).

In operation, as a sheet is conveyed by the drum 20 and belt 23, the corona charger 42 effects discharge toward the belt 23 to deposit a charge on the belt 23. At this instant, since the belt 23 has a resistance of $9\times10^7\ \Omega$ to $9.4\times10^7\ \Omega$, the charge is prevented from being immediately released to ground. Hence, a charge necessary for image transfer can be deposited on the belt 23 in the vicinity of the drum 20. Moreover, the current control means 37 controls the current from the power source 26 to the corona charger 42 such that the difference between the current $I_1$ flown to the wire of the charger 42 and the currents I2 to flow from the casing 43 and belt 23 to ground remains constant. It follows that although the resistance of the belt 23 may change, the charge to be deposited from the belt 23 on the drum 20 can be maintained constant to in turn maintain the charge necessary for image transfer substantially constant between the drum 20 and the belt 23. As a result, the quality of a transferred image is enhanced.

The operation described above is also proved by the data shown in FIGS. 10–12. In this embodiment, the voltage and current shown in FIGS. 10–12 are similarly applicable to the corona charger 32. Regarding the effects, this embodiment is substantially comparable with the previous embodiment.

As described above, the illustrative embodiment provides a guide for determining a positional relation between members constituting an image transferring device as well as the materials of such members, and positions the members on the basis of the guide. Hence, when a transfer bias for setting the surface potential of a sheet is applied, there are obviated the dielectric breakdown of a photoconductive element and that of a transfer belt and noise otherwise introduced in electric control circuitry. It follows that the transfer bias and the discharge for preventing a sheet from wrapping around the photoconductive element and from being incompletely separated from the transfer belt can function effectively.

In accordance with the present invention, a current control means controls a current from a power source to a contact electrode such that a current to flow from the transfer belt to the photoconductive element remains constant. Therefore, a charge necessary for substantial image transfer is maintained constant between the photoconductive element and the transfer belt although various factors including the environment, the property of a sheet, the resistance of the transfer belt and the area of an image may change. This enhances quality image transfer. Moreover, since the contact electrode used to achieve such an advantage is located at a position where a charge is not injected into a sheet before the sheet reaches the photoconductive element, the transfer of the true charge to the sheet is delayed to prevent the sheet from wrapping around the photoconductive element and from being incompletely separated.

Furthermore, the current control means controls the current from the power source to the contact electrode such that a difference between a current to the transfer belt and a current to ground remains constant. Therefore, although the resistance of the belt may change, a charge necessary for substantial image transfer is maintained constant between the photoconductive element and the transfer belt. Since a contact member is provided for detecting a current to flow to ground, it is possible to determine a current to the transfer belt and a current to ground with accuracy.

In addition, a particular voltage range which the power source can apply may be preselected in order to produce an alarm when the voltage does not lie in such a range. This surely eliminates an occurrence that no current is fed to the transfer belt to render the image transfer defective.

Figure 15:
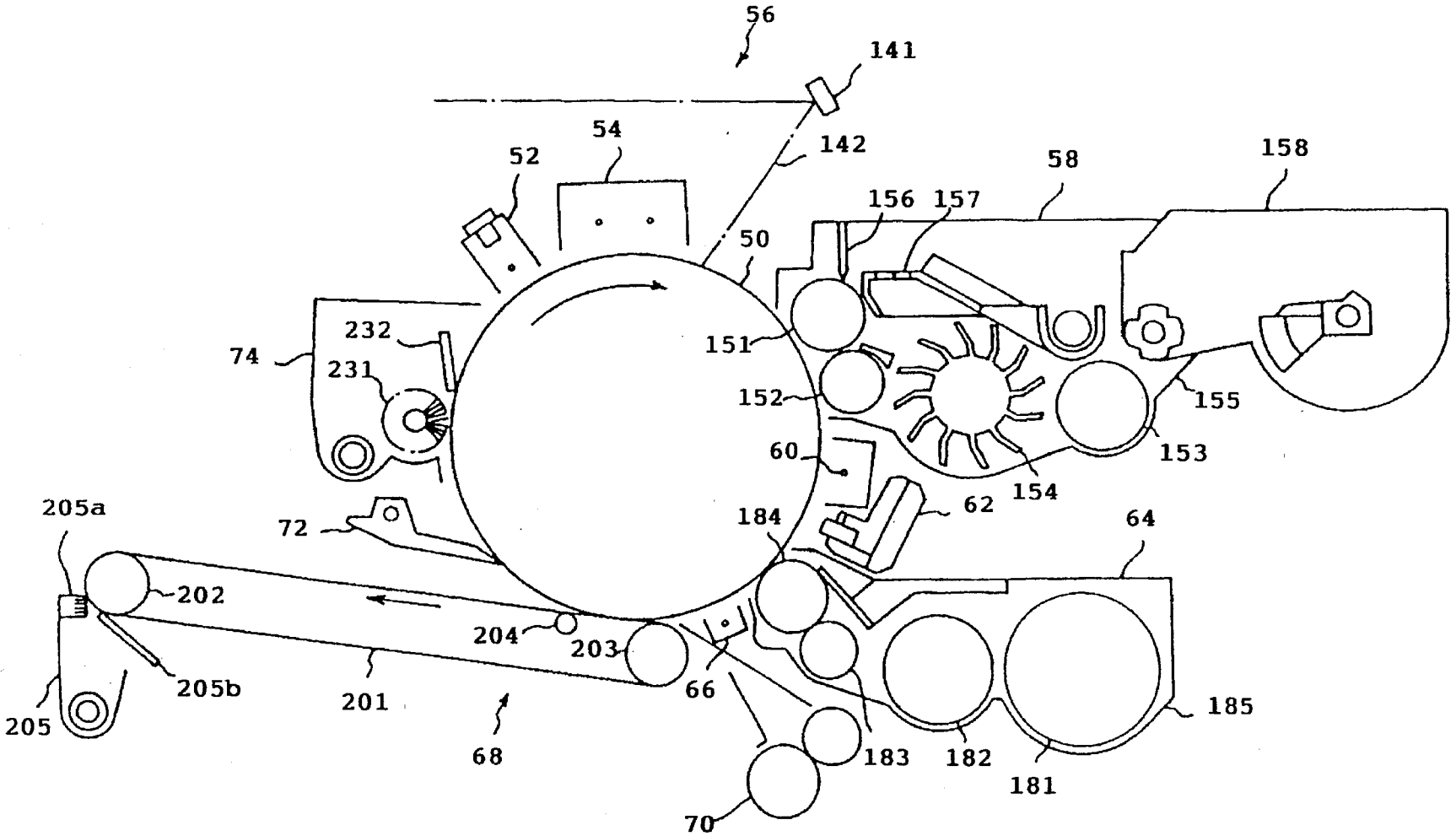
FIG. 15 is a section showing image forming equipment implemented by an alternative embodiment of the present invention.

Referring to FIG. 15, an alternative embodiment of the present invention will be described. The figure shows image forming equipment of the type having two charging means, two exposing means or writing units, and two developing devices for forming a bicolor image at a time. As shown, an image carrier 50 is implemented as a photoconductive drum and rotated by a main motor, not shown. A discharging means 52 consists of a discharge lamp and a discharger and illuminates the surface of the drum 50 being rotated. As a result, a reference voltage of 0 V to −100 V is deposited on the surface of the drum 50. Subsequently, a first charging means or charger 54 uniformly charges the surface of the drum 50 to about −850 V. Digital image data representing a document image (black image data) are sent from a device, not shown, to a line driver included in a first exposing means or writing unit 56. The digital image data have a multilevel signal format having eight bits for a pixel. A laser driver drives a laser diode in accordance with the image data from the line driver. A laser beam issuing from the laser diode is steered by a polygon mirror, passed through an f-theta lens, reflected by a first mirror, a second mirror and a third mirror 141, and focused onto the drum 50. In the portions of the drum 50 illuminated by the laser beam 142 from the third mirror 141 (image portions), the surface potential changes to 0 V to −100 V and forms an electrostatic latent image representing the black portions of the document image. In this sense, the charger 54 and first writing unit 56 constitute a latent image forming means.

A first developing device 58 deposits black toner on the latent image formed on the drum 50 to thereby produce a corresponding black toner image. The developing device 58 includes developing rollers 151 and 152, an agitating roller 153, and a paddle 154 for agitation. During development, the rollers 151, 152, 153 and paddle 154 are rotated by a drive means. The roller 153 and paddle 154 sequentially convey a developer, which is a toner and carrier mixture and contained in a casing 155, while agitating it. The developer is deposited on the sleeve 151 by magnets accommodated in the sleeve 151. While the developer is conveyed by the sleeve 151, it is partly scraped off by a doctor 156 to form a uniform layer on the sleeve 151. The developer passed through between the drum 50 and the sleeves 151 and 152 is returned to the casing 155 and again agitated by the roller 153 and paddle 154. At the same time, the developer scraped off the sleeve 151 by the doctor 156 drops into the casing 155 via a separator 157 and is also agitated by the roller 153 and paddle 154.

While the developer is circulated as stated above, it develops the latent image on the drum 50 at the position between the drum 50 and the sleeves 151 and 152. Fresh toner is replenished into the casing 155 from a hopper 158. A bias voltage of about −600 V is applied from a power source to the sleeves 151 and 152. The non-image portions of the drum 50, as distinguished from the image portions, remain at the potential of about −850 V, so that no toner deposits on such portions despite the development.

The first charging step by the charger 54, the first exposing step by the first Writing unit 56, and the first developing step by the first developing device 58 occur only when a bicolor mode or a black-and-white mode is selected on an operation panel. In a monocolor (red/blue) mode also selectable on the operation panel, the charger 54, first writing unit 56 and first developing unit 58 are rendered inoperative, i.e., the above-mentioned steps are not effected.

Subsequently, the drum 50 undergoes the second charging step, second exposing step and second developing step respectively effected by a second charging means or charger 60, a second exposing means or writing unit 62, and a second developing device 64. These steps occur only when the bicolor mode or the monocolor (red/blue) mode is selected on the operation panel. In the black-and-white mode, the charger 60, writing unit 62 and developing device 64 are held inoperative; the black toner image on the drum 50 is brought to an image transfer position alone.

In the bicolor mode or the monocolor mode, the surface of the drum 50 is again charged to about −850 V by the charger 60. Digital image data representing a color component other than the black component, e.g., a red or blue component are sent from the device, not shown, to a line driver included in the writing unit 62. A laser driver amplifies the image data. Again, the image data have a multilevel signal format having eight bits for a pixel. The laser driver drives a laser diode in accordance with the image data from the line driver.

A laser beam issuing from the laser diode is steered by a polygon mirror, passed through an f-theta lens, reflected by mirrors, and focused onto the drum 50. In the portions of the drum 50 illuminated by the laser beam (image portions), the surface potential changes to 0 V to −100 V and forms an electrostatic latent image representing the red or blue portions of a document image. In this sense, the charger 60 and writing unit 64 constitute a latent image forming means.

The second developing device 64 deposits red or blue toner on the latent image formed on the drum 50 to thereby produce a red or blue toner image. The developing device 64 includes agitating rollers 181 and 182, a scooping roller 183, and a developing roller 184. During development, the rollers 181, 182, 183 and paddle 184 are rotated by a drive means to circulate the red or blue toner stored in a casing 185 while agitating it. The developing roller 184 conveys the color toner to the drum 50 with the result that the latent image on the drum 50 is developed to produce a red or blue toner image.

A bias voltage of about −750 V is applied from a power source to the developing roller 184. The color toner does not deposit on the non-image portions of the drum 50, as distinguished from the image portions, despite the development. A pretransfer discharger 66 discharges the surface of the drum 50 moved away from the developing device 64. A transferring means 68 is implemented as conveyor belt device and transfers the toner image from the drum to a sheet fed from a sheet feeding device. Specifically, the sheet from the sheet feeding device is once stopped by a registration roller 70 and again driven toward the transferring means 68 such that the leading edge thereof meets that of the leading edge of the toner image.

The transferring means 68 has a belt 201, a drive roller 202 and a driven roller over which the belt 201 is passed, a bias roller 204 held in contact with the inner surface or rear of the belt 201, and a cleaning device 205. The drive roller 202 is connected to the main motor by a gear train. When the main motor is energized, the belt 201 is rotated and, at the same time, brought into contact with the drum 50 by a mechanism, not shown. When the main motor is deenergized, the belt 201 is released from the drum 50 by the same mechanism.

When the sheet is driven toward the transferring means 68 by the registration roller 70, a bias opposite in polarity to the black toner and color toner is applied from a high-tension power source 206 (see FIG. 16) to the bias roller 204. At the nip between the belt 201 and drum 50, the bias charges the sheet to the polarity opposite to the polarity of the toner via the bias roller 204 and belt 201. As a result, the toner image is transferred from the drum 50 to the sheet.

The bias applied from the power source 206 to the belt 201 via the bias roller 206 causes the sheet to electrostatically adhere to the belt 201. The belt 201 conveys the sheet while causing the toner image to be transferred from the drum 50 to the sheet. After the image transfer, the sheet is electrostatically separated from the drum 50. When such electrostatic separation fails, a separator 72 positively separates the sheet from the drum 50. On reaching a position where the drive roller 202 is located, the sheet is separated from the belt 201 due to its own flexibility, i.e., by curvature. Then, the sheet is driven out as a copy via a fixing unit having a heat roller and a press roller. The cleaning device 205 removes the toner remaining on the belt 201 with a brush 205*a* and a blade 205*b*. On the other hand, the toner remaining on the drum 50 is removed by a brush 231 and a blade 232 constituting a cleaning device 74.

Figure 16:
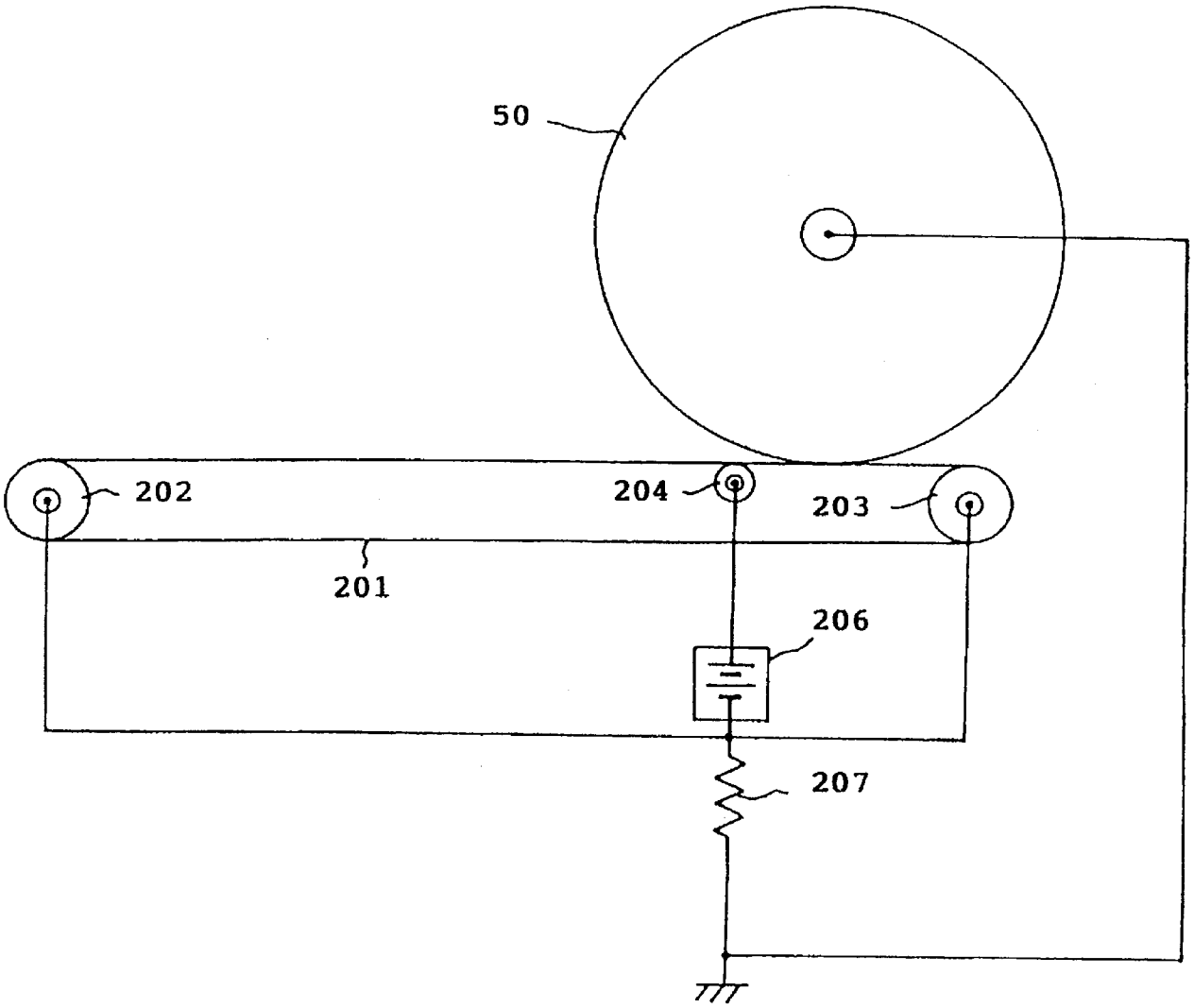
FIG. 16 shows an image transfer section included in the alternative embodiment specifically.

The conveyor belt device 20 will be described in detail. The belt 201 has a resistance ranging from $1\times10^{6}\cdot\Omega.cm$ to $1\times10^{12}\cdot\Omega.cm$. The belt 201 can transfer a toner image stably at all times without regard to changes in its own resistance, environment and sheet thickness. The bias roller 204 is held in contact with the portion of the belt 201 downstream of the nip with respect to the direction of rotation of the belt 201. When the main motor is energized, the bias roller 204 is rotated by the belt 201. The drive roller 202 and driven roller 203 play the role of feedback electrodes in place of, for example, metallic plates. Specifically, these rollers 202 and 203 are made of conductive metal and surely function as feedback electrodes. At the same time, such rollers 202 and 203 exert a minimum of resistance to the movement of the belt 201, simplifies the construction of the image transferring device, and reduces the cost. As shown in FIG. 16, the rollers 202 and 203 are connected to the low voltage or ground terminal of the power source 206. The low voltage terminal is connected to ground via a current sensing resistor 207. The drum 50 is connected to ground via the equipment body. The resistor, or current sensing means, 207 senses a transfer current contributing to the image transfer.

Figure 17:
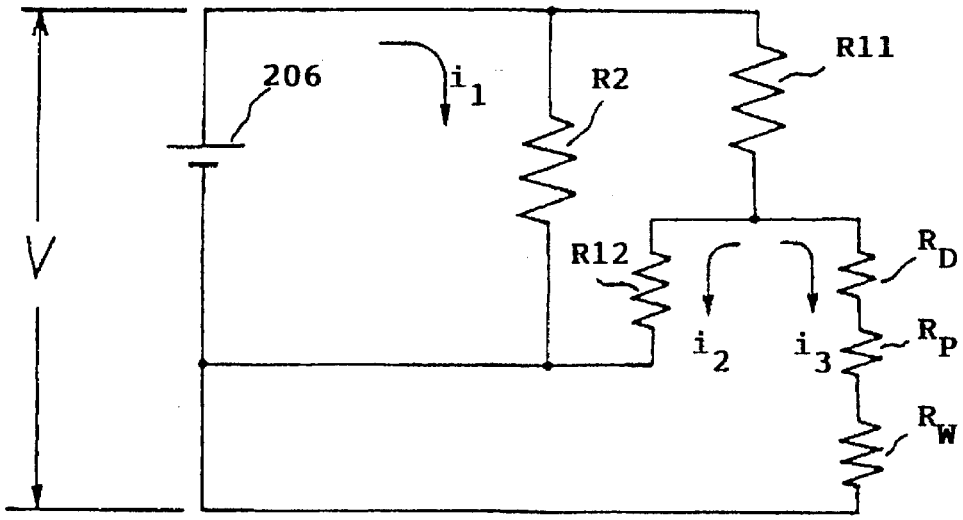
FIG. 17 is a circuit diagram showing the equivalent circuit of the image transfer section.

FIG. 17 shows the equivalent circuit of the image transfer section. The circuit includes a resistance $R_{11}$ between the bias roller 204 and the nip of the belt 201 and the drum 50, a resistance $R_{12}$ between the nip and the driven roller 203, a resistance $R_2$ between the bias roller 204 and the drive roller 202, a resistance $R_D$ of the drum 50, a resistance $R_P$ of the sheet, and a resistance $R_W$ of the resistor 207. A resistance $R_1$ between the bias roller 204 and the driven roller 203 is expressed as $R_{11}+R_{12}$. Also included in the circuit are a current $i_1$ flowing from the power source 206 to the drive roller 202 via the bias roller 204 and belt 201, a current $I_2$ flowing from the power source 206 to the driven roller 203 via the roller 204 and belt 201, and a current $i_3$ flowing from the power source 206 to the drum 50 via the roller 204, belt 201, and sheet.

The power source 206 is turned on when the sheet driven by the registration roller 70 is to be conveyed by the belt 201, so that the bias is applied to the bias roller 204. At this instant, a bias current fed from the power source 206 to the bias roller 204 flows :through the belt 201, sheet, and drum 50 while partly flowing through the belt 201, drive roller 202, and driven roller 203.

The current $i_3$ flown from the bias roller 204 to the drum 50 via the belt 201 is the transfer current contributing to image transfer. Although this current $i_3$ flows to ground via the equipment body, it returns to the power source 206 via the current sensing resistor 207. The feedback currents $i_1$ and $i_2$ respectively flown from the bias roller 204 to the drive roller 202 and driven roller 203 via the belt 201 return to the power source 206 without the intermediary of the resistor 207. Therefore, the transfer current flowing through the resistor 207 can be determined on the basis of the potential difference between the opposite ends of the resistor 207 and the resistance $R_W$ of the resistor 207.

In this embodiment, the power source 26 is made up of a bias power source and a constant current control section. The bias power source applies the bias current to the bias roller 204. The constant current control section controls the transfer current flowing from the bias power source to the resistor 207 to a reference current. It is to be noted that the transfer current is a difference between the current output from the bias roller 204 and the feedback current input to the feedback electrodes 202 and 203. The constant current control section controls the output current of the power source by PWM pulses and updates the duty ratio of PWM pulses (or the gain of the output current of the power source) at a preselected frequency matching the voltage on the resistor 207, thereby maintaining the bias current constant. As a result, the electric field for image transfer formed by the surface potential of the toner layer on the drum 50 and that of the sheet at the nip is maintained constant. This insures desirable transfer of the toner image from the drum 50 to the sheet without regard to changes in the resistance of the belt 201, environment, and sheet thickness.

Figure 18:
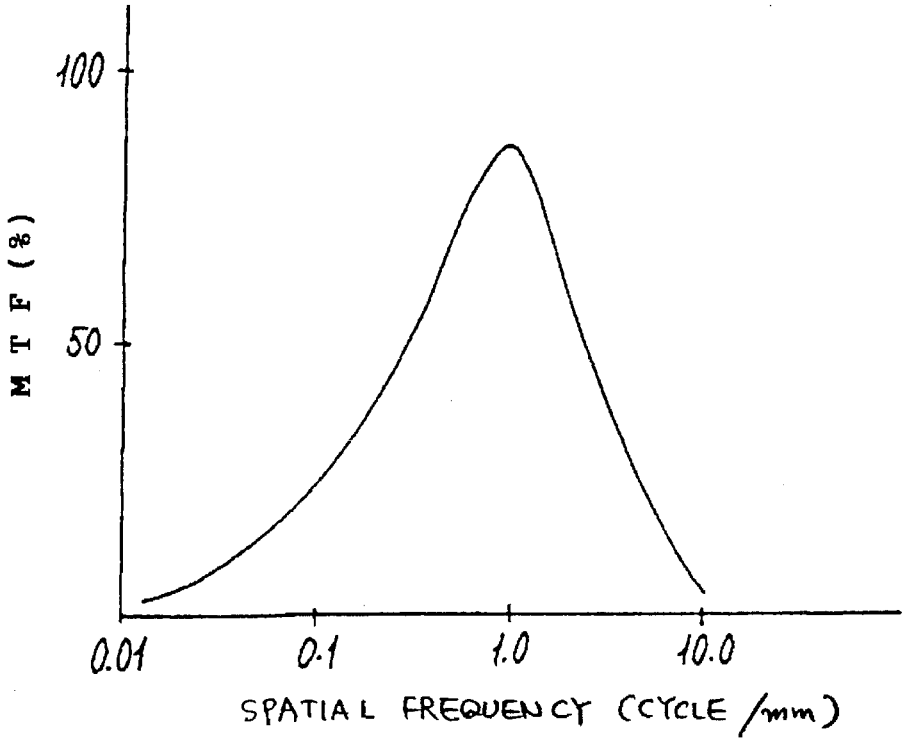
FIG. 18 is a graph indicating a relation between the MTF of eyesight and the spatial frequency.

The MTF (Modulation Transfer Function) of eyesight and the spatial frequency (i.e., the frequency at which irregularities or changes in density occur) have a relation shown in FIG. 18. On the other hand, the banding of a reproduced image and the spatial frequency have a relation shown in FIG. 19.

Figure 19:
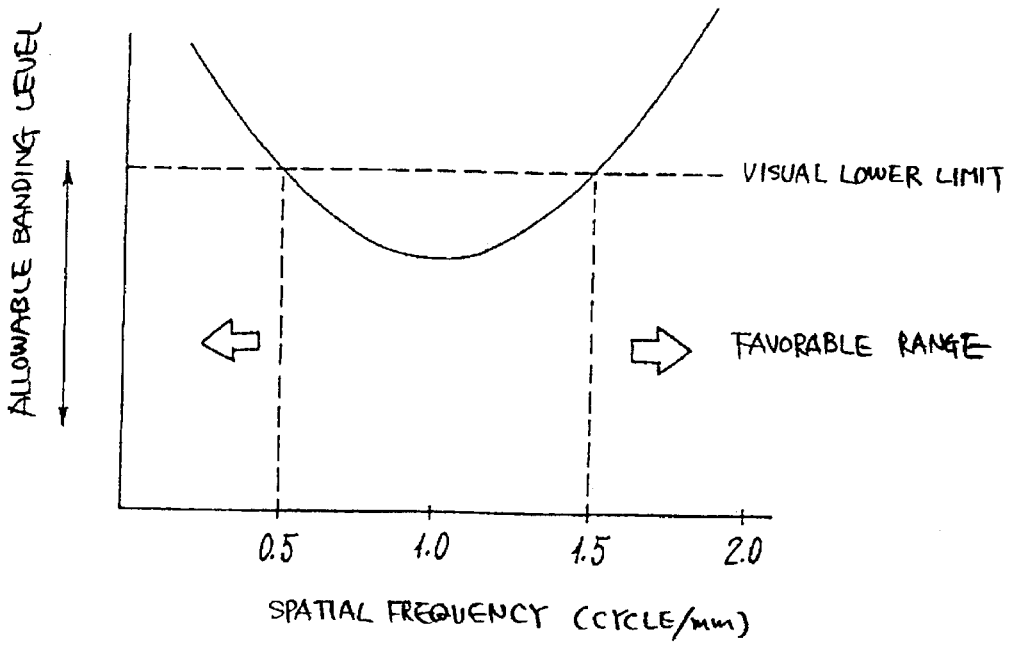
FIG. 19 is a graph indicating a relation between the binding to occur in an image and the spatial frequency.

In the power source, the constant current control section controls the output current of the bias power source by PWM pulses and updates the duty ratio of PWM pulses (or the gain of the output current of the bias power source) at a preselected frequency matching the voltage on the resistor 207, as stated earlier. In accordance with an aspect of the invention, the control updating frequency (cycles/sec) is coordinated with a feeding speed (mm/sec), e.g., of the transfer belt, the image carrier, or the sheet upon which the image is produced, to provide a spatial frequency (cycle/mm), i.e., the updating frequency (cycle/sec) divided by speed (mm/sec), which prevents undesirable banding from appearing in the reproduced image. This can be achieved by selecting an updating frequency for a given or predetermined feeding speed so as to provide the desired spatial frequency (representing the updating frequency per a particular speed). The embodiment, considering the relations shown in FIGS. 18 and 19, selects an updating frequency (period) lower than the spatial frequency of 0.5 cycle/mm, which is higher than the lower limit of the visual allowable range, or higher than 1.5 cycle/mm or lower than one dot line (period of time necessary for one dot line of image to be written) available with the laser beams of the writing units 56 and 62. In other words, when a voltage is updated at a predetermined frequency or every predetermined period in order to effect constant current control, fine irregularities in density will likely occur at such a frequency and, as shown in FIG. 19, when irregularities having periods of approximately one cycle/mm, so-called banding is most conspicuous to human eyesight. To make density irregularities inconspicuous to human eyesight, the voltage is updated at a period or frequency outside of the range between 0.5 cycle/mm to 1.5 cycle/mm. Thus, the updating frequency is less than 0.5 cycle/mm or greater than 1.5 cycle/min. This successfully prevents banding from appearing in a reproduced image at the updating frequency of the transfer current.

Figure 20:
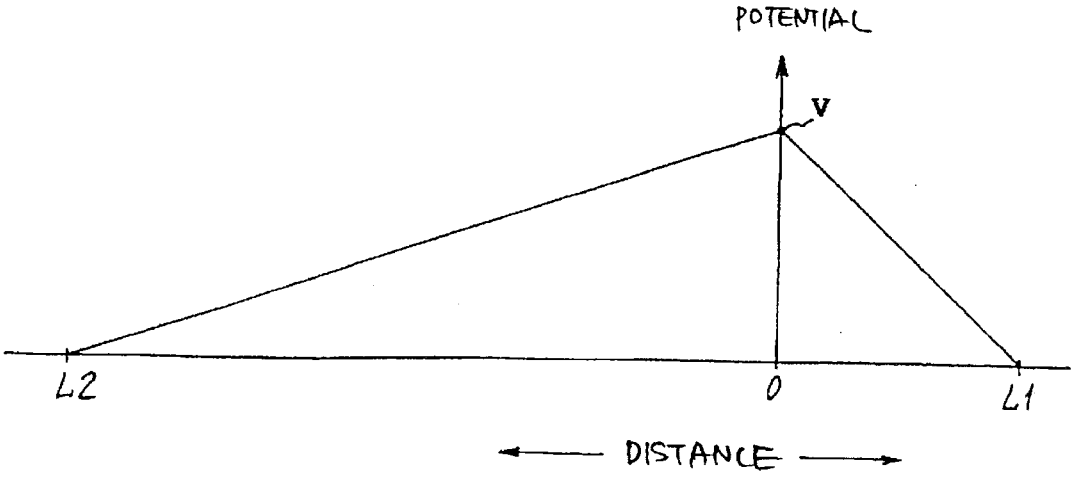
FIG. 20 shows a potential distribution particular to the alternative embodiment.

As shown in FIG. 17, the current $i_3$ contributes to image transfer, but the currents $i_1$ and $i_2$ are feedback currents not contributing to image transfer. Since the embodiment maintains the transfer current $i_3$ constant by the constant current control section of the power source 206, the bias voltage from the power source 206 to the bias roller 204 is determined by the resistance ($R_{11}$, $R_D$, $R_P$ and $R_W$) of the line along which the current $i_3$ flows and the transfer current $i_3$. Hence, if the resistance $R_{11}$ is higher than the resistance $R_2$, the current $i_1$ not contributing to image transfer increases and requires the bias power source to have a greater capacity. Such a system is poor in efficiency. As shown in FIG. 20, assume that the distance between the bias roller 204 and the driven roller 203 is $L_1$, and the distance between the bias roller 204 and the driven roller 204 is $L_2$. The embodiment sets up a relation $L_1<L_2$ such that a relation $R_1<R_2$ holds, thereby reducing the capacity required of the bias power source.

FIG. 20 shows the potentials of the drive roller 202 and driven roller and the potentials between the bias roller 204 and the drive roller 202 and driven roller 203. As shown, the potential has a certain value at the bias roller 204 due to the bias voltage applied from the power source 206 to the roller 204 and the resistance of the belt 201, although it depends on the resistance of the belt 201 and that of the sheet. On the other hand, the potentials of the drive roller 202 and driven roller 203 depend on the resistance of the resistor 207 and the preselected transfer current. Assuming that the resistor 207 has a resistance of 100 kΩ and the preselected transfer current is 20 μA, the potentials of the rollers 202 and 203 are about 2 V (substantially 0 V).

As shown in FIG. 20, the potential distribution upstream of the nip of the belt 201 is continuous and linear. Such a distribution prevents the toner image from being transferred from the drum 50 to the sheet before the sheet reaches the nip (premature transfer), thereby obviating a blurred image and a print. Since the bias roller 204 is located downstream of the nip with respect to the direction of rotation of the belt 201, the electrostatic adhesion of the sheet to the belt 201 is maximum at a position downstream of the nip and where the bias roller 204 is located. This promotes the separation of the sheet from the drum 50. A potential gradient also shown in FIG. 20 occurs between the bias roller 204 and the drive roller 202. Therefore, at the side downstream of the bias roller 204, the belt 201 and sheet are continuously discharged during sheet transport. Consequently, the potential on the belt 201 and, therefore, the adhesion of the sheet to the belt 201 is sequentially reduced. Therefore, the sheet is easily separated from the belt 201 on reaching the drive roller 202.

As stated above, the illustrative embodiment has various advantages as enumerated below.

(1) Desirable image transfer is achievable without regard to changes in the resistance of a belt, environment, and sheet thickness. In addition, a bias for image transfer is prevented from leaking.

(2) A toner image is prevented from being transferred from an image carrier to a sheet before the sheet reaches a transfer position. This eliminates a blurred image and a print.

(3) The resistance to the movement of the belt can be reduced as far as possible.

(4) The construction is simplified, and the cost is reduced.

(5) A potential gradient occurs on the belt between a bias member and a second feedback electrode. Hence, the belt and transfer medium are continuously discharged at the side downstream of the bias member during the transport of the medium. As a result, easy separation of the medium from the belt is promoted.

(6) A charge to be applied to the belt via the bias member can be implemented by a power source having a small capacity.

(7) Banding is eliminated.

Various modifications will become possible for those skilled in the art after receiving the teachings of the present disclosure without departing from the scope thereof. For example, the drum 50 shown in FIG. 15 may be replaced with a photoconductive belt, photoconductive sheet or similar image carrier, if desired.

What is claimed is:

1. An image forming equipment comprising a movable image carrier, a latent image forming means for electrostatically forming a latent image on said image carrier, a developing device for developing said latent image to produce a corresponding toner image, and an image transferring device for transferring said toner image from said image carrier to a transfer medium, said image transferring device comprising:

a belt for causing the toner image to be transferred from the image carrier to the transfer medium while conveying said transfer medium;

a bias member for applying a charge opposite in polarity to toner of said toner image to said belt;

a drive means for driving said belt;

feedback electrode means including at least a first feedback electrode through which a feedback current from said belt flows;

a constant current control means for executing constant current control such that a difference between a current flow from said bias member to said belt and a feedback current flow from said belt to said feedback electrode means remains constant, wherein said constant current control means includes means for controlling current utilizing a PWM control and means for updating a PWM duty ratio at a PWM duty ratio updating frequency; and the equipment further including a current sensing resistor disposed between first and second nodes, and a power source for providing current to said bias member, wherein said feedback electrode means and said power source are connected to said first node, and wherein said image carrier is connected to said second node.

2. A device as claimed in claim 1, wherein said first feedback electrode is a roller over which said belt is passed.

3. A device as claimed in claim 2, wherein said feedback electrode means further includes a second feedback electrode located downstream of said nip and through which a feedback current from said belt flows.

4. A device as claimed in claim 3, wherein said second feedback electrode is a roller over which said belt is passed.

5. A device as claimed in claim 3, wherein a distance between said first feedback electrode and said bias member is greater than a distance between said second feedback electrode and said bias member.

6. A device as claimed in claim 3, wherein said belt has a resistance ranging from $1\times10^{6}$ Ω·cm to $10^{12}$ Ω·cm.

7. A device as claimed in claim 1, wherein said belt has a resistance ranging from $1\times10^{6}$ Ω·cm to $10^{12}$ Ω·cm.

8. A device as claimed in claim 1, wherein said PWM duty ratio updating frequency is based on a voltage across said current sensing resister.

9. A device as claimed in claim 8, wherein said second node is grounded.

10. A device as claimed in claim 1, wherein said second node is grounded.

11. An image forming equipment comprising a movable image carrier, a latent image forming means for electrostatically forming a latent image on said image carrier, a developing device for developing said latent image to produce a corresponding toner image, and an image transferring device for transferring said toner image from said image carrier to a transfer medium, said image transferring device comprising:

a belt for causing the toner image to be transferred from the image carrier to the transfer medium while conveying said transfer medium;

a bias member for applying a charge opposite in polarity to toner of said toner image to said belt;

a drive means for driving said belt;

feedback electrode means including at least a first feedback electrode through which a feedback current from said belt flows; and a constant current control means for executing constant current control such that a difference between a current flow from said bias member to said belt and a feedback current flow from said belt to said feedback electrode means remains constant;

said bias member comprising a bias roller located downstream of a nip between the image carrier and said belt with respect to an intended direction of rotation of said belt;

wherein said constant current control means executes the constant current control based on a PWM control, said PWM control being operated to provide a spatial frequency which is one of (a) lower than 0.5 cycle/mm, and (b) higher than 1.5 cycle/mm, wherein the spatial frequency is obtained by dividing a PWM duty ratio updating frequency (cycles/sec) or a PWM gain updating frequency (cycles/sec) by a speed (mm/sec), wherein said speed is the speed of one of the image carrier, the belt, and the transfer medium.

12. An image forming equipment comprising a movable image carrier, a latent image forming means for electrostatically forming a latent image on said image carrier, a developing device for developing said latent image to produce a corresponding toner image, and an image transferring device for transferring said toner image from said image carrier to a transfer medium, said image transferring device comprising:

a belt for causing the toner image to be transferred from the image carrier to the transfer medium while conveying said transfer medium;

a bias member for applying a charge opposite in polarity to toner of said toner image to said belt, said bias member comprising a bias roller located downstream of a nip between the image carrier and said belt with respect to an intended direction of rotation of said belt;

a drive means for driving said belt;

a first feedback electrode through which a feedback current from said belt flows, wherein said first feedback electrode comprises a roller over which said belt is passed, said roller being located upstream of said nip; and a constant current control means for executing constant current control such that a difference between a current flow from said bias member to said belt and a feedback current flow from said belt to said first feedback electrode remains constant;

the image forming equipment further comprising a current sensing resistor disposed between first and second nodes, and a power source for providing current to said bias member, wherein said first feedback electrode and said power source are connected to said first node, and wherein said image carrier is connected to said second node.

13. A device as claimed in claim 12, further comprising a second feedback electrode located downstream of said nip and through which a feedback current from said belt flows.

14. A device as claimed in claim 13, wherein said second feedback electrode comprises a roller over which said belt is passed.

15. An image forming equipment as claimed in claim 12, wherein said second node is grounded.

16. An image forming equipment comprising a movable image carrier, a latent image forming means for electrostatically forming a latent image on said image carrier, a developing device for developing said latent image to produce a corresponding toner image, and an image transferring device for transferring said toner image from said image carrier to a transfer medium, said image transferring device comprising:

a belt for causing the toner image to be transferred from the image carrier to the transfer medium while conveying said transfer medium;

a bias member for applying a charge opposite in polarity to toner of said toner image to said belt, said bias member comprising a bias roller located downstream of a nip between the image carrier and said belt with respect to an intended direction of rotation of said belt;

a drive means for driving said belt;

a first feedback electrode through which a feedback current from said belt flows, wherein said first feedback electrode comprises a roller over which said belt is passed, said roller being located upstream of said nip; and a constant current control means for executing constant current control such that a difference between a current flow from said bias member to said belt and a feedback current flow from said belt to said first feedback electrode remains constant;

the image forming equipment further comprising a current sensing resistor disposed between first and second nodes, and a power source for providing current to said bias member, wherein said first feedback electrode and said power source are connected to said first node, and wherein said second node is grounded.

17. An image forming equipment comprising a movable image carrier, a latent image forming means for electrostatically forming a latent image on said image carrier, a developing device for developing said latent image to produce a corresponding toner image, and an image transferring device for transferring said toner image from said image carrier to a transfer medium, said image transferring device comprising:

a belt for causing the toner image to be transferred from the image carrier to the transfer medium while conveying said transfer medium;

a bias member for applying a charge opposite in polarity to toner of said toner image to said belt, said bias member comprising a bias roller located downstream of a nip between the image carrier and said belt with respect to an intended direction of rotation of said belt;

a drive means for driving said belt;

a first feedback electrode through which a feedback current from said belt flows, wherein said first feedback electrode comprises a roller over which said belt is passed, said roller being located upstream of said nip; and a constant current control means for executing constant current control such that a difference between a current flow from said bias member to said belt and a feedback current flow from said belt to said first feedback electrode remains constant;

the image forming equipment further including means for operating said constant current control means provide a spatial frequency which is one of: (a) lower than 0.5 cycle/mm, and (b) higher than 1.5 cycle/mm, wherein the spatial frequency is obtained by dividing an updating frequency of the control means (cycles/sec) by a speed (mm/sec), and wherein said speed is the speed of one of the image carrier, the belt, and the transfer medium.

* * * * *